US009520013B2

(12) United States Patent
Erikawa

(10) Patent No.: US 9,520,013 B2
(45) Date of Patent: Dec. 13, 2016

(54) PRODUCT DISPENSING DEVICE

(71) Applicant: FUJI ELECTRIC CO., LTD., Kawasaki-shi, Kanagawa (JP)

(72) Inventor: Hajime Erikawa, Kumagaya (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 15/218,357

(22) Filed: Jul. 25, 2016

(65) Prior Publication Data

US 2016/0335832 A1 Nov. 17, 2016

Related U.S. Application Data

(63) Continuation of application No. PCT/JP2015/052377, filed on Jan. 28, 2015.

(30) Foreign Application Priority Data

Mar. 19, 2014 (JP) ..... 2014-055924

(51) Int. Cl.
*B65H 3/44* (2006.01)
*G07F 11/24* (2006.01)
(Continued)

(52) U.S. Cl.
CPC ..... *G07F 11/24* (2013.01); *G07F 11/10* (2013.01); *G07F 17/0014* (2013.01)

(58) Field of Classification Search
CPC ..... G07F 11/24; G07F 11/10; G07F 17/0014; G07F 11/06; G07F 11/50; G07F 11/48
(Continued)

(56) References Cited

U.S. PATENT DOCUMENTS 4,405,059 A * 9/1983 Kull ..... B65G 1/08 221/129
4,565,300 A * 1/1986 Kokubun ..... G07F 11/10 221/116
(Continued)

FOREIGN PATENT DOCUMENTS

JP H04-34689 A 2/1992
JP 11283096 A * 10/1999
(Continued)

OTHER PUBLICATIONS

PCT/ISA/210, "International Search Report for PCT/JP2015/052377," Apr. 7, 2015.
(Continued)

*Primary Examiner* — Rakesh Kumar
(74) *Attorney, Agent, or Firm* — Manabu Kanesaka

(57) ABSTRACT

A product dispensing device includes: product accommodating passages; a dispensing mechanism which regulates a product from moving toward the downstream side in a standby state, and dispenses a product positioned at the most downstream side; a disc-shaped member which rotates in one or another direction; link members each of which has a standby attitude in a normal state to cause the dispensing mechanism to be in the standby state, and causes the dispensing mechanism to be driven when swinging from the standby attitude to have a dispensing attitude; and a hook member which causes the link member to swing to have the dispensing attitude when the disc-shaped member rotates in the one direction so that the distal end abuts against the link member, and retreats from the radially outer region when the disc-shaped member rotates in the other direction so that the distal end abuts against the link member.

3 Claims, 19 Drawing Sheets

(51) Int. Cl.
*G07F 11/10* (2006.01)
*G07F 17/00* (2006.01)

(58) Field of Classification Search
USPC ..... 221/1, 92, 288, 277, 116, 115, 298, 281,221/301, 124
See application file for complete search history.

(56) References Cited

U.S. PATENT DOCUMENTS 4,574,980 A * 3/1986 Kurosawa ..... G07F 11/24 221/116
4,854,477 A * 8/1989 Kurosawa ..... G07F 11/24 221/1
5,366,111 A * 11/1994 Ahn ..... B65G 47/1407 221/200
5,799,824 A * 9/1998 Gasiel ..... G07F 11/16 221/112
6,336,568 B1 * 1/2002 Tucker ..... A47F 1/10 221/131
6,902,084 B2 * 6/2005 Bauman ..... A47F 1/10 221/115
7,431,176 B2 * 10/2008 Bauman ..... A47F 1/10 221/115
2014/0175116 A1 * 6/2014 Chen ..... G07F 11/48 221/277
2016/0155287 A1 * 6/2016 Yasaka ..... G07F 11/04 221/14

FOREIGN PATENT DOCUMENTS

JP 2001188953 A * 7/2001
JP 2002-208060 A 7/2002
JP 2002-230635 A 8/2002
JP 2002230635 A * 8/2002
JP 2002288732 A * 10/2002
JP 2003-168157 A 6/2003
JP 2003168157 A * 6/2003
JP 2003-233867 A 8/2003
JP 2004288070 A * 10/2004
JP 4407086 B2 2/2010
JP WO 2015105150 A1 * 7/2015 ..... G07F 11/24

OTHER PUBLICATIONS

PCT/ISA/237, "Written Opinion of the International Searching Authority for PCT/JP2015/052377," Apr. 7, 2015.

* cited by examiner

PRODUCT DISPENSING DEVICE

CROSS-REFERENCE TO RELATED APPLICATION(S)

This application is a continuation of PCT international application Ser. No. PCT/JP2015/052377 filed on Jan. 28, 2015 which designates the United States, incorporated herein by reference, and which claims the benefit of priority from Japanese Patent Application No. 2014-055924, filed on Mar. 19, 2014, the entire contents of which are incorporated herein by reference.

BACKGROUND

The present disclosure relates to a product dispensing device.

In the related art, a vending machine to sell a product, for example, a canned beverage, a pet-bottled beverage and the like is provided with a product accommodating rack in a product storage box inside a main cabinet serving as a vending machine main body. The product accommodating rack includes a plurality of product accommodating passages extending in the vertical direction and a dispensing device disposed in a lower part of the respective product accommodating passages.

In general, the dispensing device is configured to include a lower pedal member and an upper pedal member. The lower pedal member and the upper pedal member are coupled with an AC solenoid, which is an actuator, via a link member, and configured to suitably move forward and backward in the product accommodating passages when the AC solenoid is turned into the energized state.

In such a dispensing device, a state is formed in which the upper pedal member moves backward from the product accommodating passage while the lower pedal member moves forward into the product accommodating passage in a standby state. Accordingly, the lower pedal member abuts against the lowermost product accommodated in the product accommodating passage, and the downward movement of the product accommodated in the product accommodating passage is regulated.

Further, in a case in which an command to dispense a product is given, the upper pedal member moves forward into the product accommodating passage via the link member when the AC solenoid is turned into the energized state in the dispensing device in the lower part of the product accommodating passage that accommodates the corresponding product, and abuts against a second product from the lowermost side, and accordingly, the product and products accommodated above the product are regulated from moving in the downward direction. In addition, when the AC solenoid is turned into the energized state, the lower pedal member moves backward from the product accommodating passage, only the lowermost product is dispensed in the downward direction, and the product slips through the lower pedal member, and then, the lower pedal member moves forward into the product accommodating passage by a biasing force of a spring. Thereafter, when the AC solenoid is turned into a non-energized state after the energized state is canceled, a state is formed in which the lower pedal member having moved forward into the product accommodating passage is regulated from moving backward, and a state is formed in which the upper pedal member moves backward from the product accommodating passage, thereby returning to the standby state described above (for example, see JP 4407086 B).

Meanwhile, the lower pedal member and the upper pedal member are moved forward and backward by turning the AC solenoid, which is the actuator, into the energized state or the non-energized state in the above-described dispensing device, and thus, the AC solenoid is disposed in the vicinity of the lower pedal member and the upper pedal member. This means that an electric component such as the AC solenoid is disposed in the vicinity of the lowermost product, which is adjusted to the sales temperature, and eventually means that the electric component such as the AC solenoid is disposed in a region in which the temperature environment is most severe. Thus, there is a risk that trouble such as failure is generated in the AC solenoid and the like due to dew condensation or the like.

There is a need for a product dispensing device which is capable of suppressing generation of trouble in a driving source of a dispensing mechanism in view of the above-described circumstances.

SUMMARY

A product dispensing device according to one aspect of the present disclosure includes: a plurality of product accommodating passages which accommodate an introduced product with a predetermined attitude; a dispensing mechanism which is disposed on each downstream side of the product accommodating passages, regulates a product accommodated in the corresponding product accommodating passage from moving toward the downstream side in a standby state, and dispenses a product positioned at the most downstream side accommodated in the corresponding product accommodating passage when being driven; a disc-shaped member which is disposed at a position spaced apart from the dispensing mechanism rotatably about a central axis thereof, and rotates in one direction or another direction by a rotational driving force applied from a rotation driving source; a plurality of link members each of which is coupled with the corresponding dispensing mechanism via a coupling member and swingably disposed in a radially outer region of the disc-shaped member, and has a standby attitude in a normal state to cause the dispensing mechanism to be in the standby state, and causes the dispensing mechanism to be driven when swinging from the standby attitude to have a dispensing attitude; and a hook member which is rotatably disposed in the disc-shaped member in a manner such that a distal end thereof moves forward and backward in the radially outer region of the disc-shaped member, has an attitude in which the distal end enters the radially outer region in a normal state, causes the link member to swing to have the dispensing attitude when the disc-shaped member rotates in the one direction so that the distal end abuts against the link member, and retreats from the radially outer region when the disc-shaped member rotates in the other direction so that the distal end abuts against the link member.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Hereinafter, a description will be given regarding preferable embodiments of a product dispensing device according to the present disclosure with reference to the appended drawings.

Figure 1:
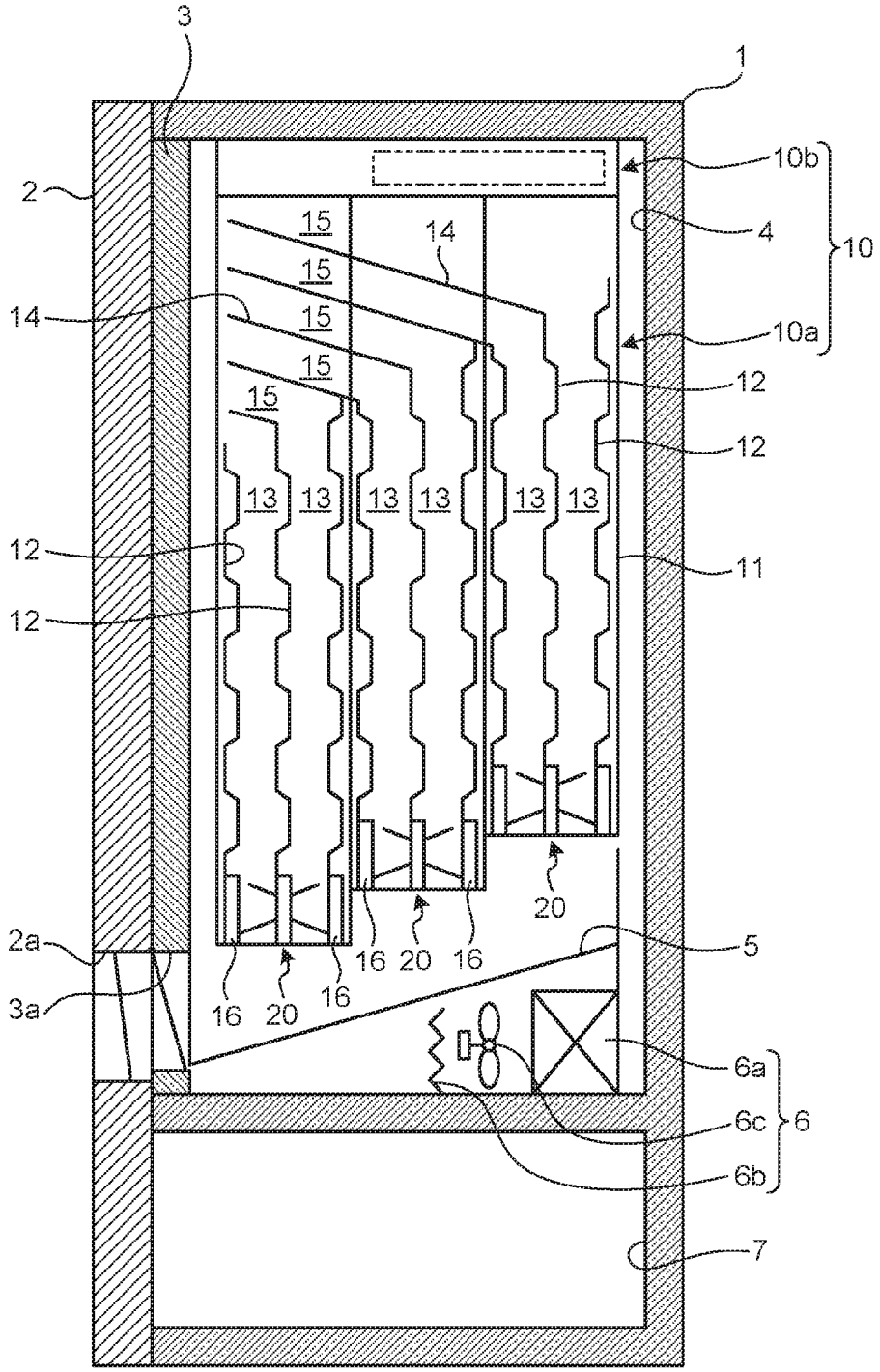
FIG. 1 is a cross-sectional side view illustrating an internal structure of a vending machine to which a product dispensing device as an embodiment of the present disclosure is applied.

FIG. 1 is a cross-sectional side view illustrating an internal structure of a vending machine to which a product dispensing device as an embodiment of the present disclosure is applied. The vending machine, which is exemplified herein, is configured to sell a product in the state of being cooled or heated, and to include a main cabinet 1, an outer door 2, and an inner door 3.

The main cabinet 1 is configured in a rectangular-parallelepiped shape with an opened front surface by suitably assembling a plurality of steel plates, and includes a product storage box 4 having a heat insulating structure therein. The outer door 2 is configured to cover the front surface opening of the main cabinet 1, and is disposed to be opened and closed in one edge portion of the main cabinet 1. Members required to sell a product, for example, a display window, a product selection button, a banknote insertion port, a coin slot, a return lever, a monetary amount indicator, a coin return port, a product removal port 2*a* and the like, are provided on a front surface of the outer door 2. The inner door 3 is a heat insulating door, which is divided into two upper and lower parts to cover a front surface opening of the product storage box 4, an upper heat insulating door is disposed to be opened and closed at one edge portion of the outer door 2 in an inward position than the outer door 2, and a lower heat insulating door is disposed to be opened and closed at one edge portion of the main cabinet 1. A product unloading port 3*a*, which is configured to unload a product outside the product storage box 4, is provided in a lower part of the lower heat insulating door in the inner door 3.

In addition, a product shooter 5 is provided inside the product storage box 4 in the above-described vending machine, a temperature adjustment unit 6 is disposed in a region (hereinafter, referred to also as a "heat exchange region") on the lower side than the product shooter 5, and a product dispensing device 10 is disposed in a region (hereinafter, referred to also as a "product accommodating region") on the upper side than the product shooter 5.

The product shooter 5 is a plate-like member which is configured to guide a product dispensed from the product dispensing device 10 to the product unloading port 3*a* of the inner door 3, and is disposed in the manner of being gradually inclined downward toward the front side. Multiple ventilation holes (not illustrated), which communicate between the heat exchange region and the product accommodating region, are bored in the product shooter 5 although not explicitly illustrated.

The temperature adjustment unit 6 is configured to maintain the internal atmosphere of the product storage box 4 to a desired temperature state, and to include an evaporator 6*a*, an electric heater 6*b*, and a blower fan 6*c* for a refrigeration cycle. For example, when the blower fan 6*c* is driven in the state of running the refrigeration cycle in the temperature adjustment unit 6, the air cooled in the evaporator 6*a* is fed in the upward direction through the ventilation hole of the product shooter 5, and thus, it is possible to maintain the product accommodating region to a low-temperature state. On the other hand, when the blower fan 6*c* is driven in the energized state of the electric heater 6*b*, the air heated by the electric heater 6*b* is fed in the upward direction through the ventilation hole of the product shooter 5, and thus, it is possible to maintain the product accommodating region to a high-temperature state. Incidentally, all of a compressor, a condenser and an expansion valve for the refrigeration cycle are disposed in a machine chamber 7 at the outside of the product storage box 4 although not explicitly illustrated.

The above-described product dispensing device 10 is configured to include a product accommodating rack 10*a* and a dispensing driving unit 10*b*.

The product accommodating rack 10*a* includes a plurality of product accommodating passages 13, which are disposed side by side in front and rear three columns in the present embodiment and configured in a meandering shape along the vertical direction by disposing a passage constituent element 12 between a pair of base side plates 11, and accommodates a plurality of products in an attitude of falling sideways along the vertical direction inside these product accommodating passages 13. When a description is given in more detail, the passage constituent element 12 is suitably disposed to oppose each of the front side and the rear side of the product accommodating passage 13, and is fixed to the base side plate 11.

In addition, a flapper is provided in the passage constituent element 12 although not explicitly illustrated. The flapper is swingably disposed in the passage constituent element 12 in the manner of moving forward and backward with respect to the product accommodating passage 13. This flapper is biased against a coil spring (not illustrated), and is in an attitude of having moved forward into the product accommodating passage 13 in a normal state. Further, the flapper moves backward along the product accommodating passage 13 having the meandering shape against a biasing force of the coil spring by abutting against a product passing through the product accommodating passage 13, and corrects an attitude of the corresponding product.

A top tray 14 is provided in an upper part of the product accommodating passage 13, and a dispensing mechanism 20 is provided in a lower part of the product accommodating passage 13 in this product accommodating rack 10*a*.

The top tray 14 is configured by bending a sheet metal having a flat plate shape, and is disposed between the base side plates 11 in the manner of being gradually inclined downward from the front toward the rear. An upper surface of the top tray 14 forms a product guide passage 15 which guides a product introduced through the slot to the product accommodating passage 13.

Figure 2:
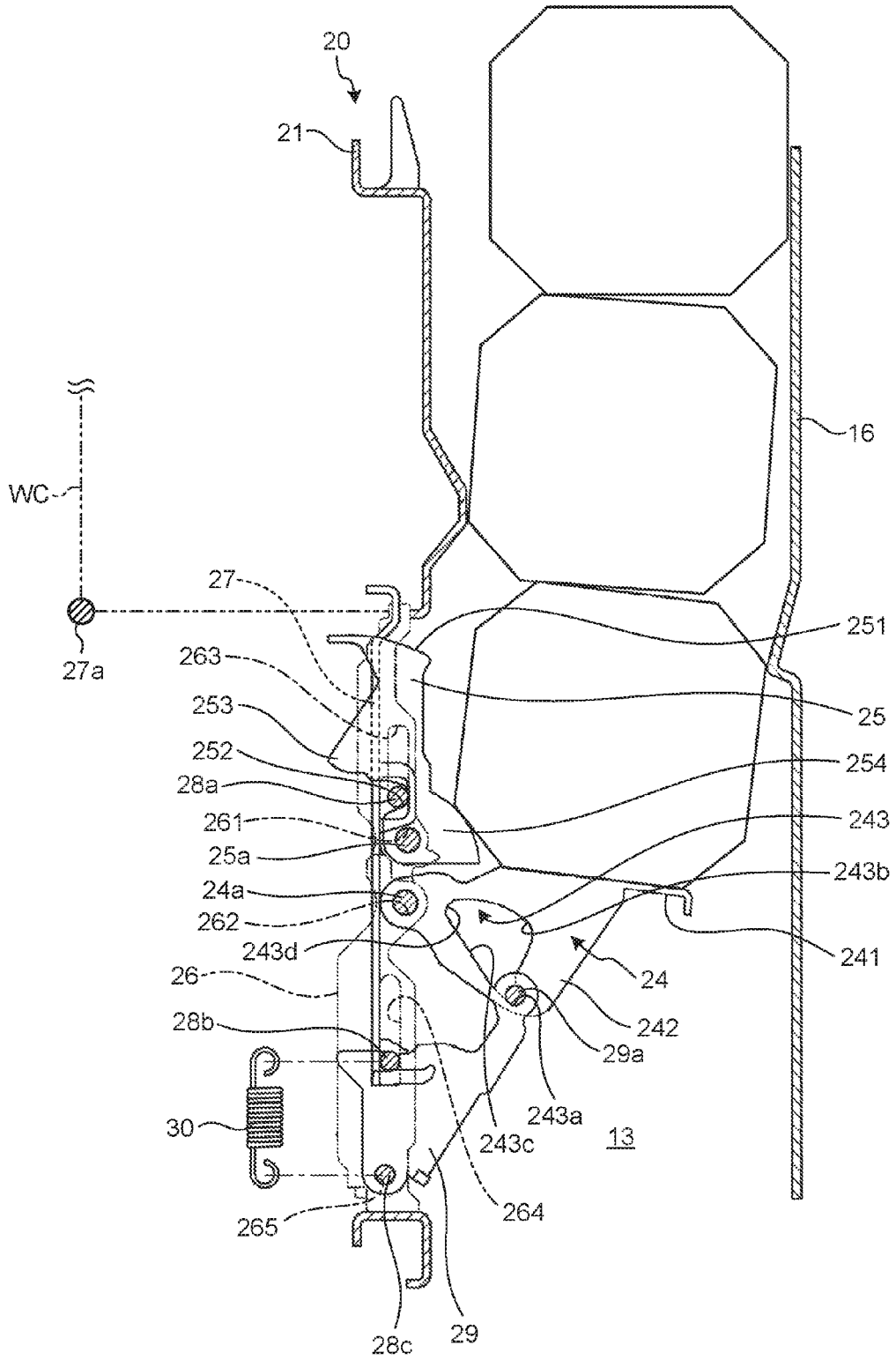
FIG. 2 is an explanatory diagram schematically illustrating a dispensing mechanism illustrated in FIG. 1 from a side.
Figure 3:
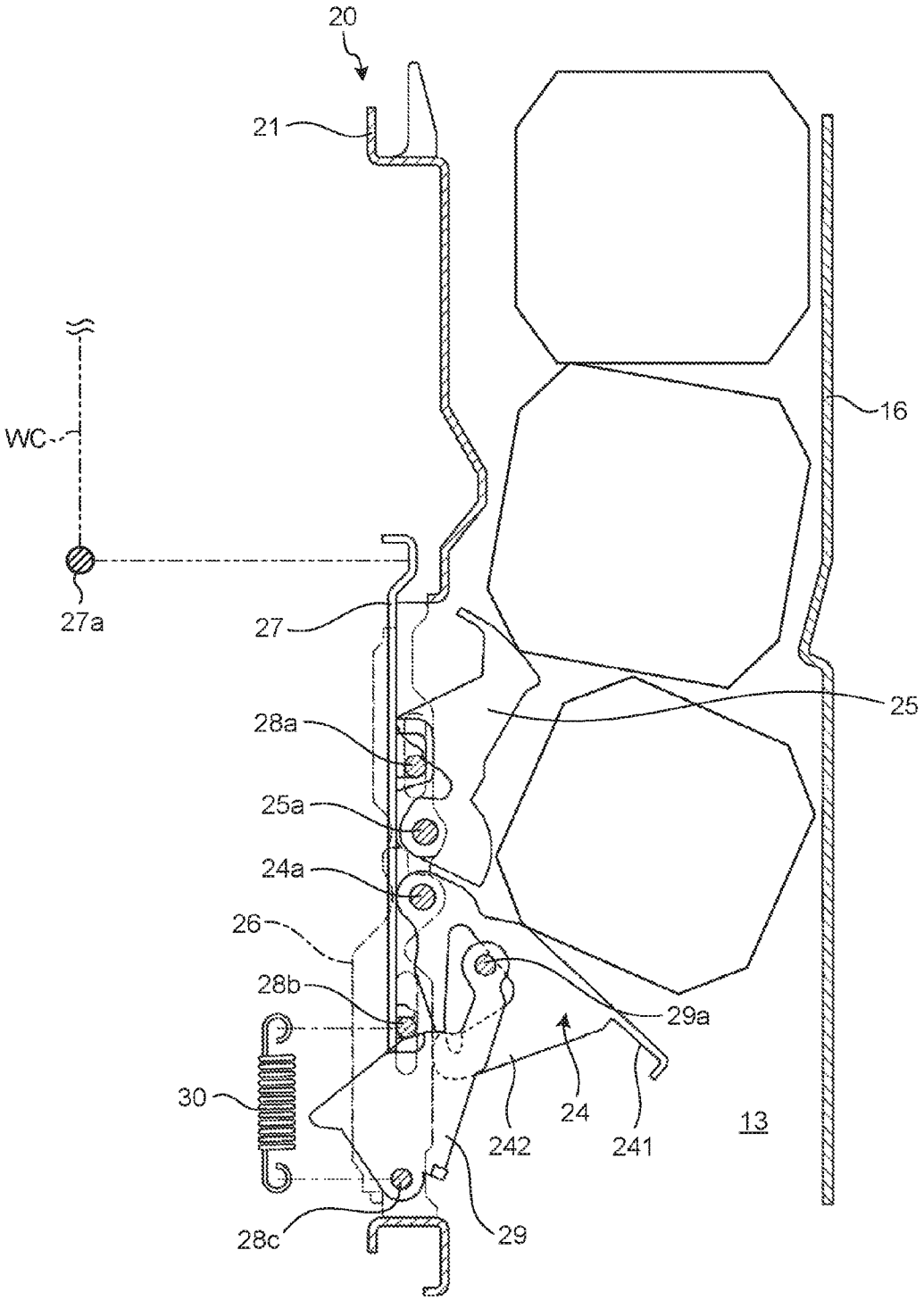
FIG. 3 is an explanatory diagram schematically illustrating the dispensing mechanism illustrated in FIG. 1 from the side.
Figure 4:
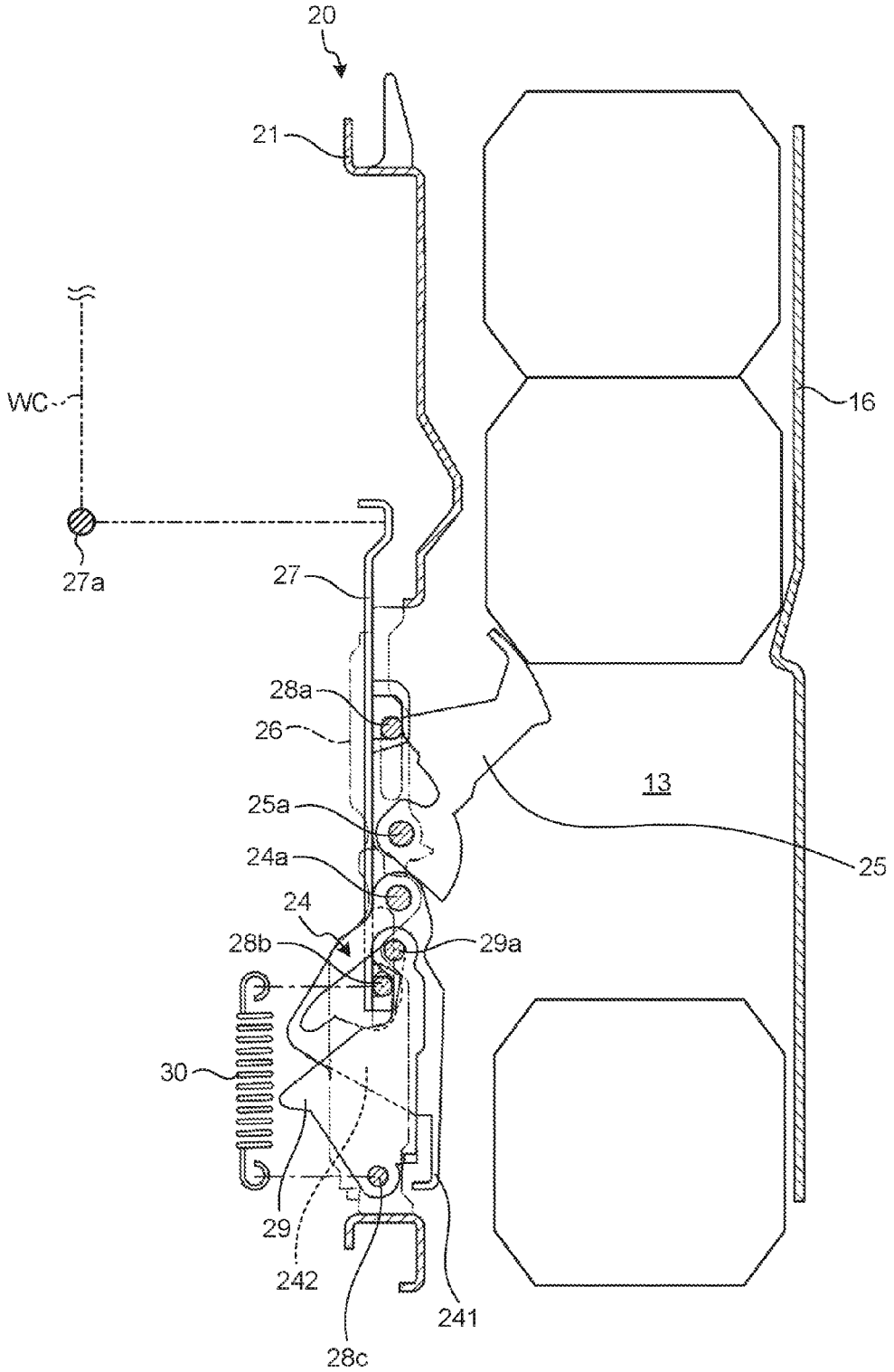
FIG. 4 is an explanatory diagram schematically illustrating the dispensing mechanism illustrated in FIG. 1 from the side.

FIGS. 2 to 4 are explanatory diagrams each of which schematically illustrates the dispensing mechanism 20 illustrated in FIG. 1 from a side. The dispensing mechanism 20, exemplified herein, is disposed in a lower part, which is a downstream side, of the product accommodating passage 13. This dispensing mechanism 20 controls a behavior of a product against an opposing passage width regulating plate 16 to serve a function to accommodate the product in the product accommodating passage 13 in a standby state and to dispense corresponding products one by one to the product shooter 5 in the driven state, and includes a base member 21. The dispensing mechanisms 20 are disposed to be tied with each other back to back between the front and rear product accommodating passages 13, which are in parallel, in the same product accommodating rack 10*a*.

The base member 21 is configured by performing a cutting process and a bending process with respect to a steel plate, and is disposed in a manner such that a surface thereof opposes the passage width regulating plate 16. An insertion hole (not illustrated), which is a rectangular through opening, is formed in a middle portion of the base member 21.

A first swing support shaft 24*a* and a second swing support shaft 25*a* are installed in a pair of right and left bearing pieces (not illustrated) which are provided in both side portions of an insertion hole of the base member 21.

The first swing support shaft 24*a* is a shaft-shaped member which is disposed in the manner of extending along the substantially horizontal direction, and supports a lower pedal 24 at a middle portion thereof. The second swing support shaft 25*a* is a shaft-shaped member which is disposed in the manner of extending along the substantially horizontal direction at a location at the upper side than the first swing support shaft 24*a*, and supports an upper pedal 25 at a middle portion thereof.

The lower pedal 24 is a plate-like member, and is disposed in the manner of being swingable about a shaft center of the first swing support shaft 24*a* as the first swing support shaft 24*a* is inserted into a proximal end of the lower pedal 24.

A distal end of the lower pedal 24 extends in a radially outward direction of the first swing support shaft 24*a*, and is capable of moving forward and backward with respect to the product accommodating passage 13 through the insertion hole when swinging about the shaft center of the first swing support shaft 24*a*. That is, the lower pedal 24 is swingably disposed in the manner of moving forward and backward with respect to the product accommodating passage 13.

A lower pedal spring (not illustrated) is interposed between the lower pedal 24 and the base member 21. The lower pedal spring constantly biases the lower pedal 24 toward a direction to cause the lower pedal 24 to move forward with respect to the product accommodating passage 13.

The lower pedal 24 includes a plate-like pedal main body portion 241 and a pair of guide portions 242. The pair of guide portions 242 is provided on a back surface side of the pedal main body portion 241. The respective guide portions 242 are plate-like members extending along the vertical direction and are formed to oppose each other. Guide grooves 243 are formed in opposing surfaces of the respective guide portions 242 which oppose each other.

The guide groove 243 includes a fitting portion 243*a*, which is positioned at the lowermost side in a state in which the lower pedal 24 is arranged at an advancing position by being moved forward the most with respect to the product accommodating passage 13 (the state illustrated in FIG. 2), and into which a pedal operating shaft 29*a* of a rotation stopper 29, to be described later, is fit, an abutment portion 243*d*, which is positioned at the uppermost side in a state in which the lower pedal 24 is arranged at a retreated position by being moved backward the most with respect to the product accommodating passage 13 (the state illustrated in FIG. 4), and against which the pedal operating shaft 29*a* of the rotation stopper 29 abuts, and a first guide portion 243*b* and a second guide portion 243*c* which continuously connect the fitting portion 243*a* and the abutment portion 243*d*.

The first guide portion 243*b* is formed in the guide portion 242 in the manner of being inclined obliquely upward from the fitting portion 243*a* to be spaced apart with respect to the base member 21, and being inclined obliquely upward to be adjacent to the base member 21 and reaching the abutment portion 243*d* in a state in which the lower pedal 24 is arranged at the position (advancing position) of being moved forward the most with respect to the product accommodating passage 13.

The second guide portion 243*c* is formed in the guide portion 242 in the manner of being inclined obliquely downward from the abutment portion 243*d* to be spaced apart with respect to the base member 21, and reaching the fitting portion 243*a* in a state in which the lower pedal 24 is arranged at the position (advancing position) of being moved forward the most with respect to the product accommodating passage 13.

A length of the lower pedal 24 in the radially outward direction from the first swing support shaft 24*a*, is set to a length with which it is possible to secure a gap, which is smaller than a maximum width of a product having a small maximum width, against the passage width regulating plate 16 as illustrated in FIG. 2 in a case in which the lower pedal 24 is positioned at the position (advancing position) of having moved forward the most with respect to the product accommodating passage 13.

The upper pedal 25 is a plate-like member, and is disposed in the base member 21 in the manner of being swingable about a shaft center of the second swing support shaft 25*a* as the second swing support shaft 25*a* is inserted into a proximal end thereof.

A distal end of the upper pedal 25 extends in a radially outward direction of the second swing support shaft 25*a*, and is capable of moving forward and backward with respect to the product accommodating passage 13 through the insertion hole when swinging about the shaft center of the second swing support shaft 25*a*. That is, the upper pedal 25 is swingably disposed in the manner of moving forward and backward with respect to the product accommodating passage 13.

The upper pedal spring (not illustrated) is interposed between the upper pedal 25 and the base member 21. The upper pedal spring constantly biases the upper pedal 25 toward a direction to cause the upper pedal 25 to move backward with respect to the product accommodating passage 13.

A pressing inclined surface 251, a concave portion 252, a stopper abutment portion 253, and a protrusion portion 254 are provided in the upper pedal 25. The pressing inclined surface 251 is provided in a distal end portion of the upper pedal 25, and is an inclined surface having a curved shape which is formed in a manner of being gradually lowered toward the product accommodating passage 13 in a case in which the upper pedal 25 is moved backward with respect to the product accommodating passage 13. The concave portion 252 is provided on a back surface side of the upper pedal 25, and is a linear concave portion extending along the substantially horizontal direction which is formed in the opening manner on both side surfaces of the upper pedal 25. The stopper abutment portion 253 is a portion against which a stopper pin 28*a*, to be described later, abuts, and is provided in a manner of being inclined above the concave portion 252 on the back surface of the upper pedal 25. The protrusion portion 254 is provided in a manner of protruding toward the product accommodating passage 13 in the proximal end of the upper pedal 25.

The upper pedal 25 is biased so as to move backward with respect to the product accommodating passage 13 by a biasing force of the upper pedal spring, and has an initial position which is set to the state of moving backward with respect to the product accommodating passage 13 as the stopper pin 28*a* abuts against the concave portion 252.

The upper pedal 25 is in the state of being inclined forward with respect to a vertical plane passing through the second swing support shaft 25*a* in the state (the state illustrated in FIG. 4) of being positioned at the position (advancing position) of having moved forward the most with respect to the product accommodating passage 13. Further, a length of the upper pedal 25 in the radially outward direction from the second swing support shaft 25*a* is set to a length with which it is possible to secure a gap, which is smaller than a maximum width of a product having a small maximum width, against the passage width regulating plate 16 in the above-described state of being inclined forward.

In addition, a bearing portion 26 is provided in the base member 21. The bearing portion 26 guides movement of a pedal link 27 in the vertical direction, is formed in the manner of extending along the vertical direction, and is provided to traverse the insertion hole such that one end is attached to an upper end edge of the insertion hole, and the other end is attached to a lower end edge of the insertion hole.

The bearing portion 26 is configured using a resin material, and thus includes a second swing support shaft insertion hole 261, a first swing support shaft insertion hole 262, a stopper pin insertion hole 263, a pedal stopper pin support groove 264, and a stopper support hole 265.

The second swing support shaft insertion hole 261 is a hole into which the second swing support shaft 25*a* is inserted, and which is configured to pivotally support the second swing support shaft 25*a*. The first swing support shaft insertion hole 262 is a hole into which the first swing support shaft 24*a* is inserted, and which is configured to pivotally support the first swing support shaft 24*a*. The first swing support shaft insertion hole 262 is formed at the lower side than the second swing support shaft insertion hole 261.

The stopper pin insertion hole 263 is a hole that pivotally supports a stopper pin 28*a*, to be described later in a slidable manner, and is formed to have a large extending length in the vertical direction as compared to a diameter of the stopper pin 28*a* formed in a shaft shape. Accordingly, the stopper pin insertion hole 263 allows movement of the stopper pin 28*a* along the vertical direction, and is provided at a part of the bearing portion 26 which is in the substantially middle between an upper end of the bearing portion 26 and a portion at which the second swing support shaft insertion hole 261 is formed.

The pedal stopper pin support groove 264 is a hole that pivotally supports a pedal stopper pin 28*b*, to be described later, in a slidable manner, and is formed to have a large extending length in the vertical direction as compared to a diameter of the pedal stopper pin 28*b* formed in a shaft shape. Accordingly, the pedal stopper pin support groove 264 allows movement of the pedal stopper pin 28*b* along the vertical direction, and is provided at a part of the bearing portion 26 which is in the substantially middle between a portion at which the first swing support shaft insertion hole 262 is formed and a lower end of the bearing portion 26.

The stopper support hole 265 is a hole which is configured to pivotally support a stopper shaft 28*c*, to be described later, and is formed in the lower end of the bearing portion 26.

In addition, the stopper pin 28*a*, the pedal stopper pin 28*b*, and the stopper shaft 28*c* are installed between one bearing piece and the bearing portion 26.

The stopper pin 28*a* is a shaft-shaped member which is disposed along the substantially horizontal direction between one bearing piece and the bearing portion 26, and has one end being inserted into a stopper pin insertion hole (not illustrated) of the bearing piece and the other end being inserted into the stopper pin insertion hole 263 of the bearing portion 26. The stopper pin 28*a* is linked to the pedal link 27, and is capable of moving along the vertical direction inside the stopper pin insertion hole 263 along with movement of the pedal link 27 in the vertical direction. In addition, the stopper pin 28*a* abuts against the concave portion 252 of the upper pedal 25 at the initial position.

The pedal stopper pin 28*b* is a shaft-shaped member which is disposed along the substantially horizontal direction between one bearing piece and the bearing portion 26, and has one end being inserted into a pedal stopper pin support groove (not illustrated) of the bearing piece, and the other end being inserted into the pedal stopper pin support groove 264 of the bearing portion 26. The pedal stopper pin 28*b* is linked to the pedal link 27, and is capable of moving along the vertical direction inside the pedal stopper pin support groove 264 along with the movement of the pedal link 27 in the vertical direction. A circumferential surface of the pedal stopper pin 28*b* abuts against an inner circumferential surface of the pedal stopper pin support groove 264 when the pedal link 27 is moved in the vertical direction.

The stopper shaft 28*c* is a shaft-shaped member which is disposed along the substantially horizontal direction between one bearing piece and the bearing portion 26, and supports the rotation stopper 29 at a middle portion thereof.

The rotation stopper 29 is disposed between one bearing piece and the bearing portion 26 in a manner such that the stopper shaft 28*c* is inserted into a proximal end thereof and the rotation stopper 29 is swingable about a shaft center of the stopper shaft 28*c*.

A distal end of the rotation stopper 29 extends in a radially outward direction of the stopper shaft 28*c*, and is capable of moving forward and backward with respect to the product accommodating passage 13 through the insertion hole when swinging about the shaft center of the stopper shaft 28*c*.

The rotation stopper 29 has a pedal operating shaft 29*a* at the distal end thereof. The pedal operating shaft 29*a* is a shaft-shaped member which is disposed along the substantially horizontal direction, and both ends thereof are fit into the guide groove 243 of the lower pedal 24.

A pedal operation member spring (not illustrated) is interposed between the rotation stopper 29 and the base member 21. The pedal operation member spring constantly biases the rotation stopper 29 toward a direction to cause the rotation stopper 29 to move forward with respect to the product accommodating passage 13.

The above-described rotation stopper 29 is biased in the direction of moving forward with respect to the product accommodating passage 13 by the pedal operation member spring, is regulated from moving in a direction of moving backward as the pedal stopper pin 28*b* abuts against a predetermined portion on a back surface side of the rotation stopper 29, and has an initial position which is set in the state of having moved forward with respect to the product accommodating passage 13. In addition, since the lower pedal 24 is biased by the lower pedal spring, the rotation stopper 29 has the initial position at which both ends of the pedal operating shaft 29*a* are positioned at the fitting portion 243*a* of the guide groove 243, and the lower pedal 24 has moved forward with respect to the product accommodating passage 13.

The pedal link 27 is an elongated plate-like member which extends along the vertical direction, and is engaged with a link shaft 27*a* installed in the base member 21. The link shaft 27*a* is coupled with the dispensing driving unit 10*b* via a wire cable WC to be described later, and is capable of moving along the vertical direction. Accordingly, the pedal link 27 is also capable of moving along the vertical direction.

A link spring 30 is interposed between the pedal link 27 and the base member 21. The link spring 30 causes the pedal link 27 to be constantly biased in the downward direction. In addition, a second link spring is interposed between the pedal link 27 and the base member 21 although not explicitly illustrated. This second link spring has one end being engaged with an engagement hole formed at a lower end of the pedal link 27, and the other end being engaged with the stopper shaft 28*c*. This second link spring is usually configured to prevent the engagement between the pedal link 27 and the pedal stopper pin 28*b* from being canceled by its own elastic force.

The stopper pin 28*a* is arranged in a lower end of the stopper pin insertion hole 263, and the pedal stopper pin 28*b* is arranged in a lower end of the pedal stopper pin support groove 264 in a state in which the pedal link 27 is biased by the link spring 30 to be arranged at the lower side. In this state, the concave portion 252 of the upper pedal 25, which has been arranged at the retreated position, abuts against the stopper pin 28*a*. Further, the rotation stopper 29, which has been arranged at the advancing position, abuts against the pedal stopper pin 28*b*, and the backward movement of the rotation stopper 29 is regulated. In addition, the pedal operating shaft 29*a* of the rotation stopper 29 arranged at the advancing position is fit into the fitting portion 243*a* of the lower pedal 24, and accordingly, the backward movement of the lower pedal 24 arranged at the advancing position is regulated.

On the contrary, the stopper pin 28*a* is arranged in an upper end of the stopper pin insertion hole 263, and the pedal stopper pin 28*b* is arranged in an upper end of the pedal stopper pin support groove 264, as illustrated in FIG. 4, in a state in which the pedal link 27 is arranged at the upper side against a biasing force of the link spring 30. In this state, the backward movement of the upper pedal 25 is regulated as the stopper abutment portion 253 of the upper pedal 25 abuts against the stopper pin 28*a*, and the upper pedal 25 moves forward and is arranged at the advancing position against a biasing force of the upper pedal spring.

Meanwhile, the regulation on the backward movement of the rotation stopper 29 caused by the pedal stopper pin 28*b* is canceled, and thus, the regulation on the backward movement is canceled around the stopper shaft 28*c*. Here, a load of a product, which abuts against the lower pedal 24 maintained at the advancing position by the rotation stopper 29, is applied to the rotation stopper 29, and the rotation stopper 29 starts to move backward as the regulation on the backward movement of the rotation stopper 29 is canceled. When the backward movement of the rotation stopper 29 starts, the pedal operating shaft 29*a* is detached from the fitting portion 243*a* of the lower pedal 24, and thus, the lower pedal 24 is allowed to move backward about the first swing support shaft 24*a*, and moves backward against an elastic biasing force of the lower pedal spring by the load of the product.

Figure 5:
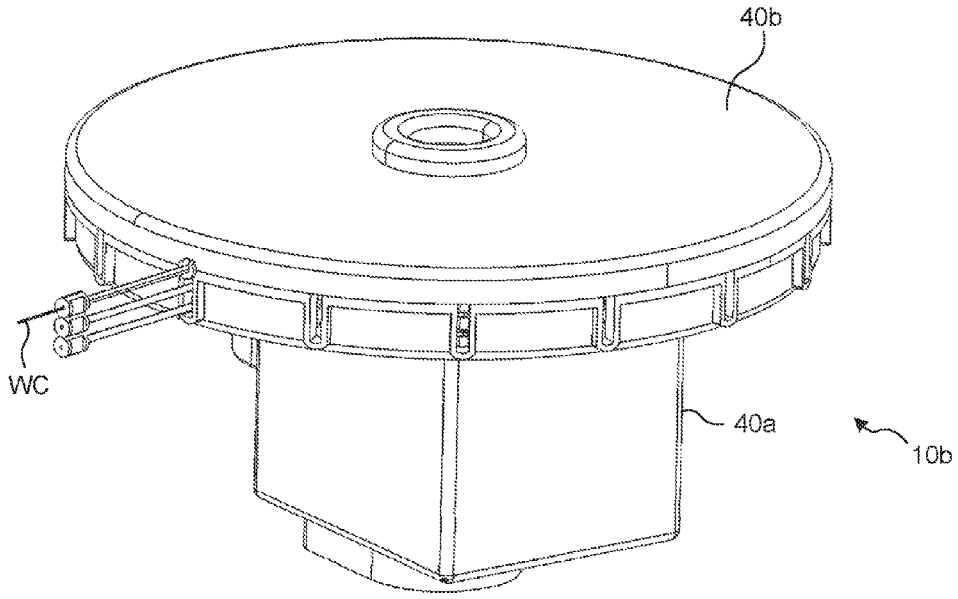
FIG. 5 is a perspective view illustrating a dispensing driving unit.
Figure 6:
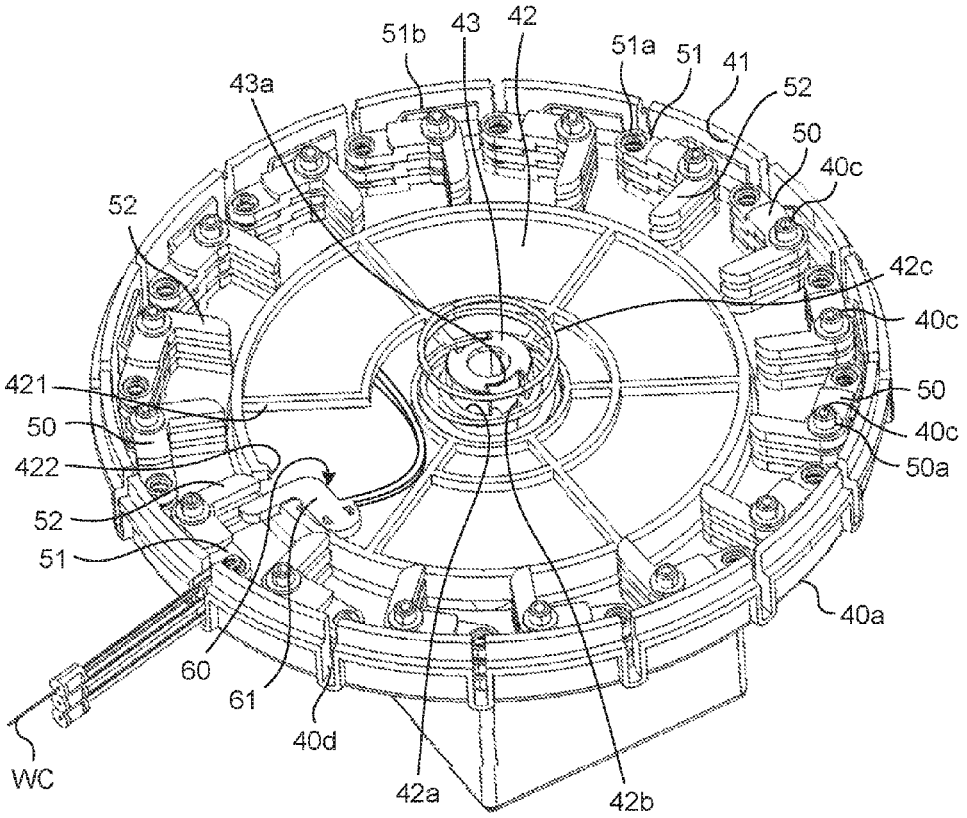
FIG. 6 is a perspective view illustrating an internal structure of the dispensing driving unit illustrated in FIG. 5.
Figure 7:
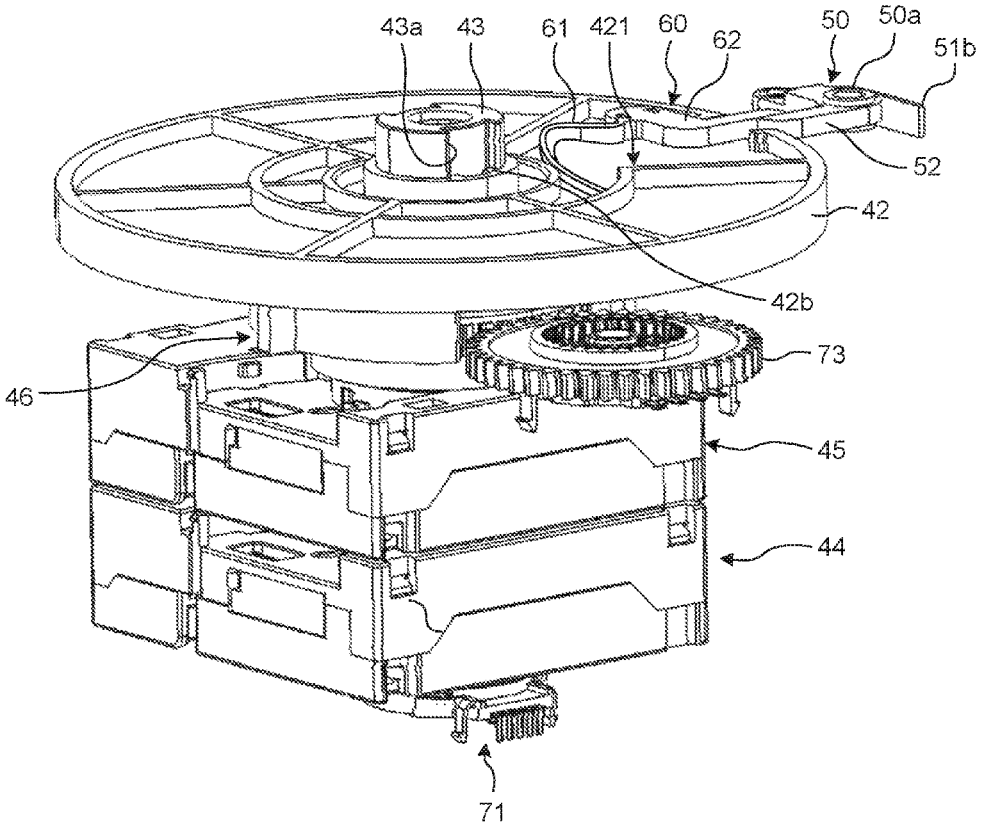
FIG. 7 is a perspective view illustrating the internal structure of the dispensing driving unit illustrated in FIG. 5.
Figure 8:
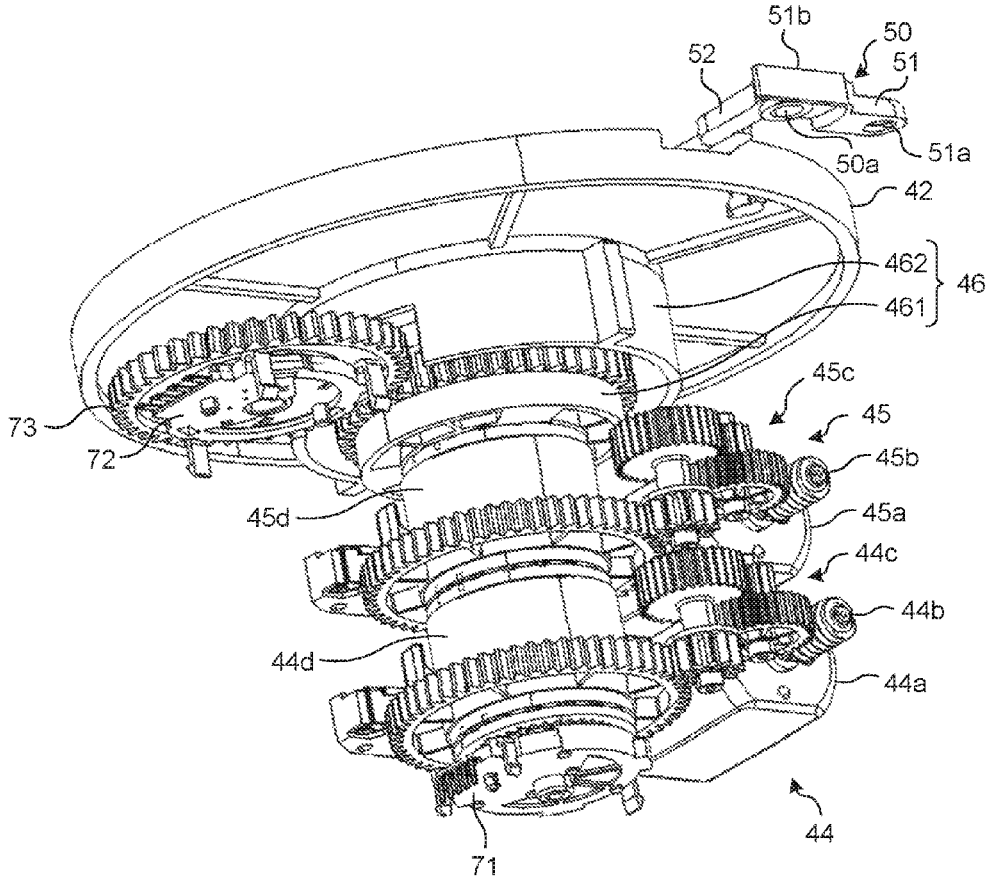
FIG. 8 is a perspective view illustrating the internal structure of the dispensing driving unit illustrated in FIG. 5.
Figure 9:
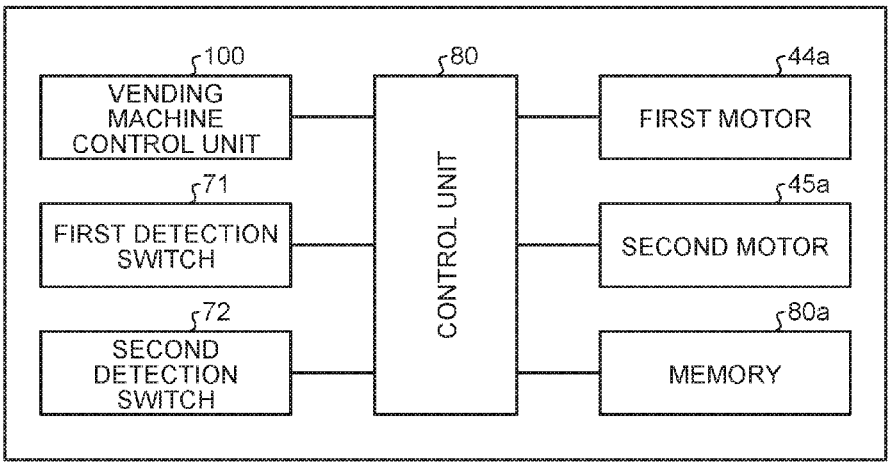
FIG. 9 is a block diagram illustrating a control system which is a characteristic of the dispensing driving unit.

FIG. 5 is a perspective view illustrating the dispensing driving unit 10*b*, FIGS. 6 to 8 are perspective views each of which illustrates an internal structure of the dispensing driving unit 10*b* illustrated in FIG. 5, and FIG. 9 is a block diagram illustrating a control system which is a characteristic of the dispensing driving unit 10*b*.

The dispensing driving unit 10*b*, exemplified herein, is disposed in an upper region of the product accommodating rack 10*a* positioned at the rearmost side among the product accommodating racks 10*a* arranged side by side in front and rear three columns, and includes a unit main body 40*a*.

The unit main body 40*a* has an opening 41 formed on an upper surface thereof, and forms a housing together with a lid body 40*b* as the opening 41 is closed by the lid body 40*b*. A rotating plate (disc-shaped member) 42, a link member 50, and a hook member 60 are disposed inside the unit main body 40*a*.

The rotating plate 42 is a plate-like body forming a circular shape, and is accommodated in an upper part of the unit main body 40*a*. A through hole 42*a* is formed in a center portion of the rotating plate 42, and a drive shaft 43, which extends along the vertical direction, penetrates through the through hole 42*a*. A convex portion 42*b*, which protrudes toward the inner side, is formed in an inner wall surface of the through hole 42*a*, and the convex portion 42*b* enters a shaft concave portion 43*a* which is formed in an outer circumferential surface of a shaft along an extending direction of the shaft (the vertical direction). Accordingly, the rotating plate 42 is capable of rotating together with the drive shaft 43 in a case in which the drive shaft 43 rotates about the central axis of the drive shaft 43, and further, is engaged with the drive shaft 43 to be movable in the extending direction of the drive shaft 43, that is, the vertical direction.

Further, a first motor unit 44 and a second motor unit 45 are disposed in a lower region of the rotating plate 42 in the manner of being penetrated by the drive shaft 43. Incidentally, reference sign 42*c* of FIG. 6 indicates a pressing spring. The pressing spring 42*c* is interposed between the lid body 40*b* and the rotating plate 42, and constantly presses the rotating plate 42 in the downward direction by its own elastic restoring force.

The first motor unit 44 has a built-in first motor 44*a* which is a driving source. The first motor 44*a* is a direct current motor capable of forward and reverse drive, and a first output shaft 44*b* is coupled with a first transmission gear 44*d* having a cylindrical shape via a first deceleration mechanism 44*c*.

The first transmission gear 44*d* is disposed to be penetrated by the drive shaft 43, and is engaged with the drive shaft 43 such that when the first transmission gear 44*d* rotates, the drive shaft 43 also rotates in an integrated manner.

Accordingly, the drive shaft 43 is rotated in the counter-clockwise direction, when seen from above, in a case in which the first motor 44*a* is driven to rotate forward in the first motor unit 44, and the drive shaft 43 is rotated in the clockwise direction, when seen from above, in a case in which the first motor 44*a* is driven to rotate reversely.

That is, the first motor unit 44 causes the rotating plate 42 to be rotated, via the drive shaft 43, in the clockwise direction or the counter-clockwise direction when seen from above.

The second motor unit 45 is disposed at the upper side of the first motor unit 44, and includes a built-in second motor 45*a* which is a driving source. The second motor 45*a* is a direct current motor capable of forward and reverse rotational drive, and a second output shaft 45*b* is coupled with a second transmission gear 45*d* having a cylindrical shape via a second deceleration mechanism 45*c*.

The second transmission gear 45*d* is disposed to be penetrated by the drive shaft 43, but is configured such that its own rotation is not transmitted to the drive shaft 43. The second transmission gear 45*d* rotates in the clockwise direction, when seen from above, in a case in which the second motor 45*a* is driven to rotate forward, and rotates in the counter-clockwise direction, when seen from above, in a case in which the second motor 45*a* is driven to rotate reversely. In addition, the second transmission gear 45*d* is coupled with a vertical movement transmission mechanism 46.

The vertical movement transmission mechanism 46 is disposed at the upper side of a second motor unit 45 and the lower side of the rotating plate 42, and includes a first transmission member 461 and a second transmission member 462.

Figure 10:
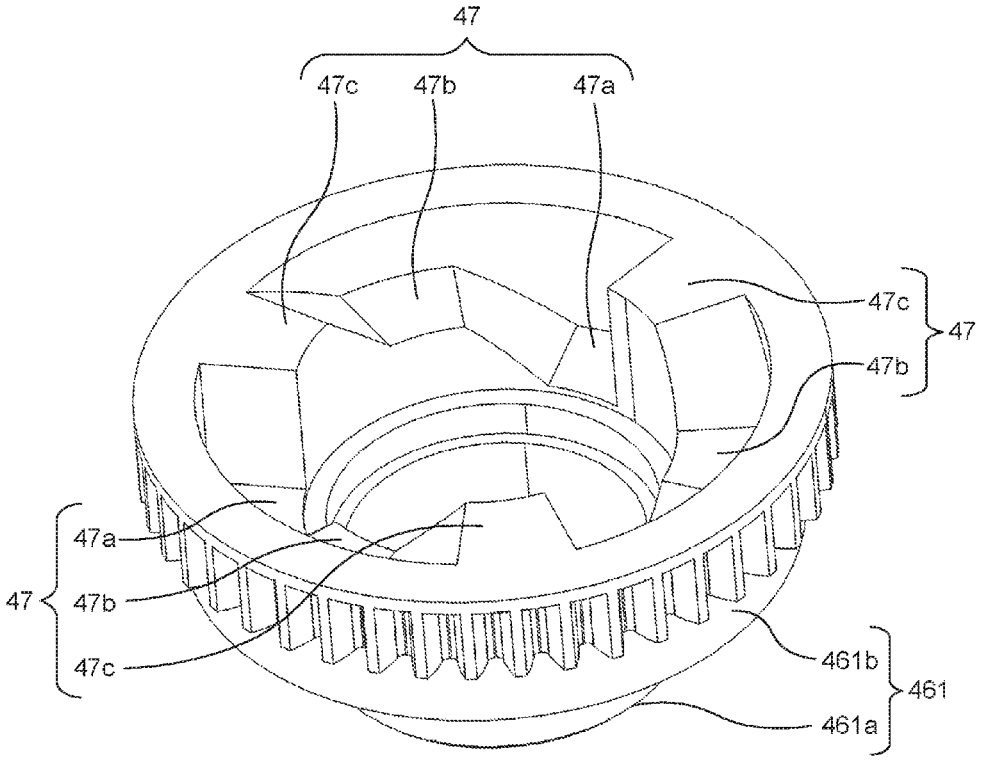
FIG. 10 is a perspective view illustrating a first transmission member configuring the dispensing driving unit illustrated in FIG. 5.

The first transmission member 461 includes a base portion 461*a* and an enlarged diameter portion 461*b* as illustrated in FIG. 10. The base portion 461*a* forms a cylindrical shape, and a lower end portion thereof is coupled with an upper end portion of the second transmission gear 45*d*. The base portion 461*a* has a hollow portion through which the drive shaft 43 penetrates. Incidentally, the rotation of the drive shaft 43 is not transmitted to the base portion 461*a* as similarly to the second transmission gear 45*d*, and further, the rotation of the base portion 461*a* is not transmitted to the drive shaft 43, either.

The enlarged diameter portion 461*b* is continuously provided to an upper end portion of the base portion 461*a*, and is a cylindrical portion having a larger outer diameter than the base portion 461*a*. Three cam portions 47 are formed on a lower surface of the enlarged diameter portion 461*b*. The cam portions 47 have a common size, and are provided each by 120 degrees along the circumferential direction. Each of the cam portions 47 includes a first planar portion 47*a* having the lowest height level, a second planar portion 47*b* having a height level higher than the first planar portion 47*a*, and a third planar portion 47*c* having a height level higher than the second planar portion 47*b*, and is configured such that each inclined surface is formed between the first planar portion 47*a* and the second planar portion 47*b*, and between the second planar portion 47*b* and the third planar portion 47*c*.

Figure 11:
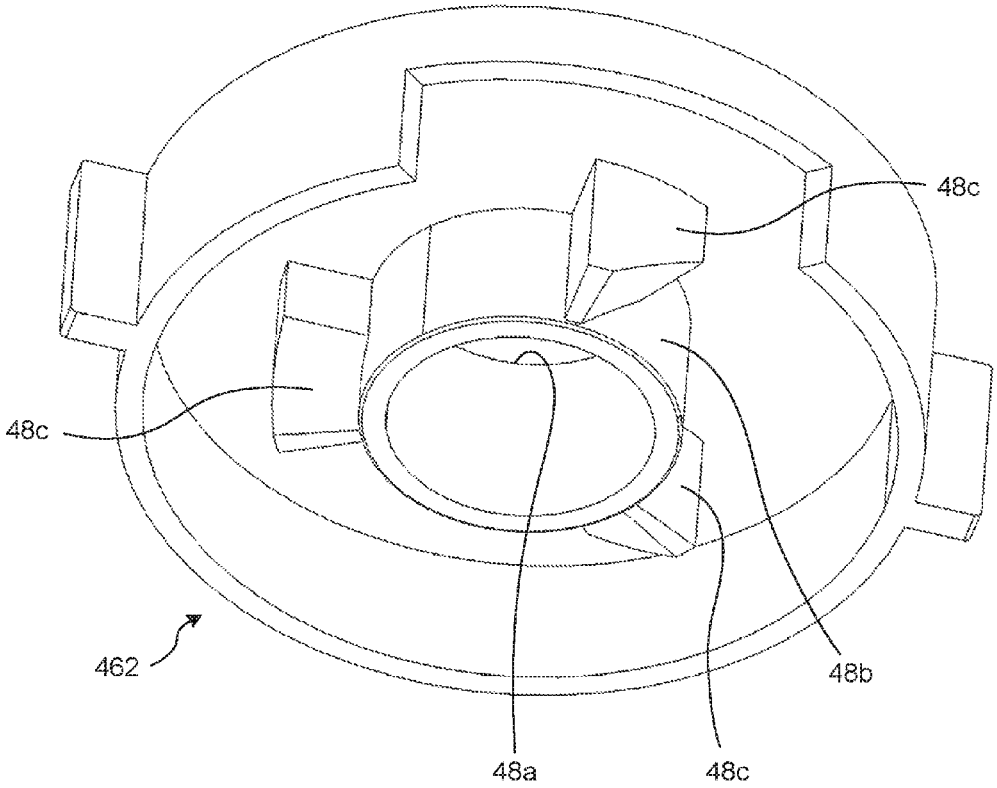
FIG. 11 is a perspective view illustrating a second transmission member configuring the dispensing driving unit illustrated in FIG. 5.

The second transmission member 462 forms a cylindrical shape having a larger outer diameter than the enlarged diameter portion 461*b* of the first transmission member 461 and a closed upper end surface. As illustrated in FIG. 11, the second transmission member 462 has an opening 48*a* which is formed in a center portion of the upper end surface to allow the penetration of the drive shaft 43, and a cylindrical support portion 48*b* with a hollow portion communicating with the opening 48*a*. The support portion 48*b* has an inner diameter dimension and an external dimension which are substantially the same as the dimensions of the base portion 461*a* of the first transmission member 461.

Further, three transmission protrusion portions 48*c* are provided at an interval of 120 degrees on a lower surface of the upper end surface of the second transmission member 462 in the manner of being continuously provided also to an outer circumferential surface of the support portion 48*b*. The transmission protrusion portion 48*c* has a lower end portion being processed in a planar shape.

The second transmission member 462 is disposed on the upper side of the first transmission member 461 as the drive shaft 43 penetrates through the hollow portion and the opening 48*a* of the support portion 48*b*, and the transmission protrusion portions 48*c* are placed at the corresponding cam portions 47, respectively. Incidentally, the rotation of the drive shaft 43 is not transmitted to the support portion 48*b* as similarly to the second transmission gear 45*d* and the base portion 461*a*, and further, the rotation of the support portion 48*b* is not transmitted to the drive shaft 43, either.

The first transmission member 461, which has the base portion 461*a* coupled with the second transmission gear 45*d*, rotates in the clockwise direction, when seen from above, in a case in which the second transmission gear 45*d* of the second motor unit 45 rotates in the clockwise direction, when seen from above, in the above-described vertical movement transmission mechanism 46. When the first transmission member 461 rotates in the clockwise direction in this manner, the transmission protrusion portion 48*c*, which has been placed at the first planar portion 47*a* of the cam portion 47, is relatively moved via the inclined surface and is placed at the second planar portion 47*b* due to the rotation of the first transmission member 461. When the transmission protrusion portion 48*c* is placed at the second planar portion 47*b* of the corresponding cam portion 47 in this manner, the second transmission member 462 moves upward to be spaced apart from the first transmission member 461, and accordingly, the rotating plate 42 is moved upward against a biasing force of the pressing spring 42*c*. Further, when the second transmission gear 45*d* further rotates in the clockwise direction when seen from above, the first transmission member 461 rotates in the clockwise direction when seen from above, and the transmission protrusion portion 48*c*, which has been placed at the second planar portion 47*b* of the cam portion 47, is relatively moved via the inclined surface and is placed at the third planar portion 47*c*. When the transmission protrusion portion 48*c* is placed at the third planar portion 47*c* of the corresponding cam portion 47 in this manner, the second transmission member 462 moves upward to be further spaced apart from the first transmission member 461, and accordingly, the rotating plate 42 is moved upward against a biasing force of the pressing spring 42*c*.

Meanwhile, the first transmission member 461, which is coupled with the second transmission gear 45*d*, rotates in the counter-clockwise direction, when seen from above, in a case in which the second transmission gear 45*d* rotates in the counter-clockwise direction when seen from above. When the first transmission member 461 rotates in the counter-clockwise direction in this manner, the transmission protrusion portion 48*c*, which has been placed at the third planar portion 47*c* of the cam portion 47, is relatively moved via the inclined surface and is placed at the second planar portion 47*b* due to the rotation of the first transmission member 461. When the transmission protrusion portion 48*c* is placed at the second planar portion 47*b* of the corresponding cam portion 47 in this manner, the second transmission member 462 moves in the downward direction so as to be adjacent to the first transmission member 461, and accordingly, the rotating plate 42 is moved downward by the biasing force of the pressing spring 42*c*. Further, when the second transmission gear 45*d* further rotates in the counter-clockwise direction when seen from above, the first transmission member 461 rotates in the counter-clockwise direction when seen from above, and the transmission protrusion portion 48*c*, which has been placed at the second planar portion 47*b* of the cam portion 47, is relatively moved via the inclined surface and is placed at the first planar portion 47*a*. When the transmission protrusion portion 48*c* is placed at the first planar portion 47*a* of the corresponding cam portion 47, the second transmission member 462 moves in the downward direction so as to be more adjacent to the first transmission member 461, and accordingly, the rotating plate 42 is moved downward by the biasing force of the pressing spring 42*c*.

That is, the second motor unit 45 causes the rotating plate 42 to move along the extending direction (axial direction) of the drive shaft 43, that is, the vertical direction via the vertical movement transmission mechanism 46. Accordingly, the rotating plate 42 moves at any one of vertically three height level (a high level, a middle level and a low level) in the present embodiment.

The link members 50 are disposed at equal intervals in an annular shape about the central axis of the drive shaft 43 (the central axis of the rotating plate 42) in a radially outer region which surrounds the rotating plate 42. When an insertion shaft 40*c*, which is formed in the unit main body 40*a*, is inserted into an insertion hole 50*a* formed in the link member 50, the link member 50 is disposed to be swingable about a shaft center with the insertion shaft 40*c* as the shaft center. The single insertion shaft 40*c* is inserted into the three link members 50 to have different height levels, and accordingly, the link members 50 are disposed at three different height levels.

The link member 50 includes a link action portion 51 and a link abutment portion 52. The link action portion 51 extends in a radially outward direction of the insertion hole 50*a*, and thus, to be specific, the link member 50 extends toward the other link member 50 neighboring in the counter-clockwise direction when seen from above. An action hole 51*a* is formed in an extending end of the link action portion 51, and one end of the wire cable WC passes through the action hole 51*a* and is attached thereto. Herein, the wire cable WC passes through 40*d* formed in the unit main body 40*a* and extends to the outside of the unit main body 40*a*. The wire cable WC is coupled with the link shaft 27*a* of the dispensing mechanism 20 which is associated with the link member 50. That is, each of the link members 50 is associated with the dispensing mechanism 20, and is coupled with the associated dispensing mechanism 20 via the wire cable WC.

The link abutment portion 52 extends in the radially outward direction of the insertion hole 50*a*, and, to be specific, extends toward the central axis of the rotating plate 42. An extending end of the link abutment portion 52 includes a side, which faces the link action portion 51 formed in the own link member 50, having a planar surface and a side opposing the abutment surface having a curved surface.

The above-described link member 50 has a standby attitude in the normal state as the pedal link 27 of the dispensing mechanism 20, associated via the wire cable WC, is biased by the link spring 30 and is positioned at a downward position. At this time, an action piece 51*b* provided in the link action portion 51 is in contact with an inner wall surface of the unit main body 40*a*.

The hook member 60 is disposed in the rotating plate 42. The hook member 60 is configured to include a hook distal end 62 at a distal end portion of a hook base portion 61 which is a curved and elongated portion. The above-described hook member 60 is accommodated in an accommodating region 421 in the elastically deformed state in a state in which an intermediate portion and a proximal end portion of the hook base portion 61 are in contact with a wall portion of the accommodating region 421 formed in an upper surface of the rotating plate 42. Further, the hook member 60 has an attitude in which the hook distal end 62 enters the radially outer region of the rotating plate 42 due to an elastic restoring force of the hook base portion 61. When a description is given in more detail, the hook distal end 62 enters the radially outer region of the rotating plate 42 in the manner of penetrating through an open portion 422, which is formed in a wall portion of a circumferential edge portion forming the accommodating region 421, and abuts against one edge portion of the open portion 422. That is, the hook member 60 is disposed in the rotating plate 42 in the state of being rotatable by an external force and its own elastic restoring force. In addition, the hook distal end 62 includes a portion facing the planar surface of the link abutment portion 52 of the link member 50 formed in a flat shape, and a portion facing the curved surface of the link abutment portion 52 of the link member 50 formed in a curved shape.

The dispensing driving unit 10*b*, which has been described as above, is provided with a first detection switch 71, a second detection switch 72, and a control unit 80 in addition to the above-described configuration.

The first detection switch 71 is disposed at a location which corresponds to a lower end of the drive shaft 43. The first detection switch 71 is configured to detect the rotation amount of the drive shaft 43, that is, to detect the rotation amount of the rotating plate 42, and to give a result of the detection to the control unit 80 as a first detection signal.

The second detection switch 72 is disposed to be coupled with a detection gear 73 meshing with a gear portion formed in the outer circumferential surface of the first transmission member 461. The second detection switch 72 is configured to detect the rotation amount of the first transmission member 461, and to give a result of the detection to the control unit 80 as a second detection signal.

The control unit 80 is configured to comprehensively control the operation of the dispensing driving unit 10*b* according to a program or data stored in a memory 80*a*.

Incidentally, information relating to the association between the link member 50 and the dispensing mechanism 20 is stored in the memory 80*a*.

The control unit 80 is communicatively connected to a vending machine control unit 100 which controls an operation of the vending machine, and further, is configured to perform processing of calculating a position of the hook distal end 62 of the hook member 60 using the first detection signal given from the first detection switch 71, and to perform processing of calculating the height level of the rotating plate 42 using the second detection signal given from the second detection switch 72. A result of the calculation in the control unit 80 is stored in the memory 80*a* if necessary.

Figure 12:
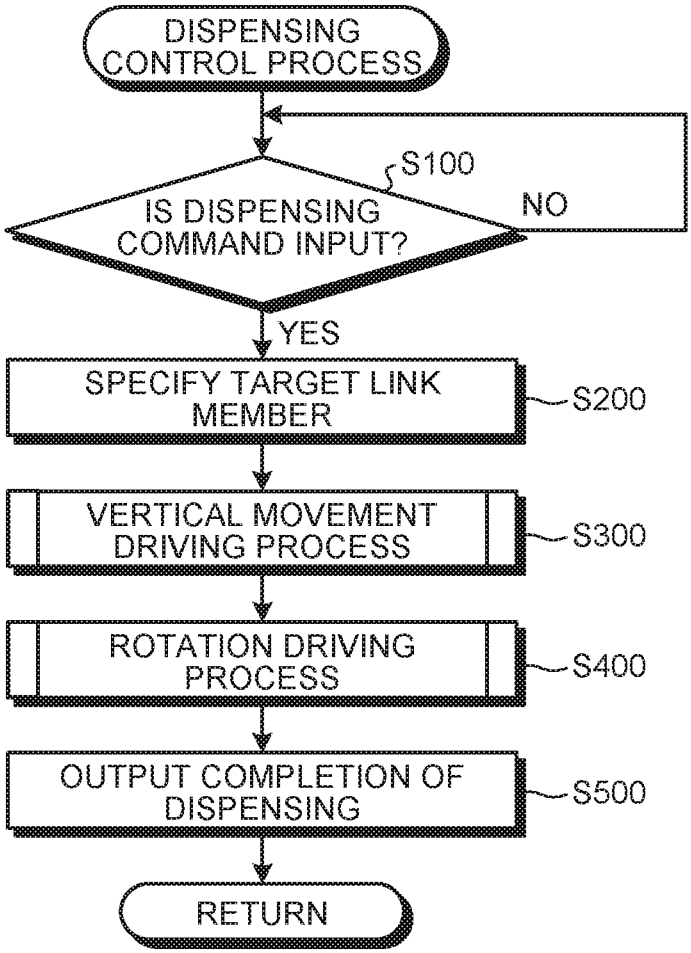
FIG. 12 is a flowchart illustrating processing content of a dispensing control process which is performed by the control unit.

FIG. 12 is a flowchart illustrating processing content of a dispensing control process which is performed by the control unit 80. A description will be given regarding an operation of the product dispensing device 10 according to the present embodiment while describing the dispensing control process. Hereinafter, it is assumed that the rotating plate 42 is at a low-level position at which the height level is the lowest, and the hook distal end 62 of the hook member 60 is positioned at a middle position between any two of the link members 50 neighboring on each other as the premise of the description.

When the dispensing command is given by the vending machine control unit 100 (step S100: Yes), the control unit 80 specifies the link member 50 serving as a target of a dispensing command (step S200) in the dispensing control process. That is, the control unit 80 specifies the link member 50 which is associated with the dispensing mechanism 20 of the product accommodating passage 13 which accommodates a product serving as the target of the dispensing command. The control unit 80, which has specified the target link member 50, performs a vertical movement driving process (step S300). Herein, the target link member 50 is assumed to be at a middle-level position with the middle height level.

Figure 13:
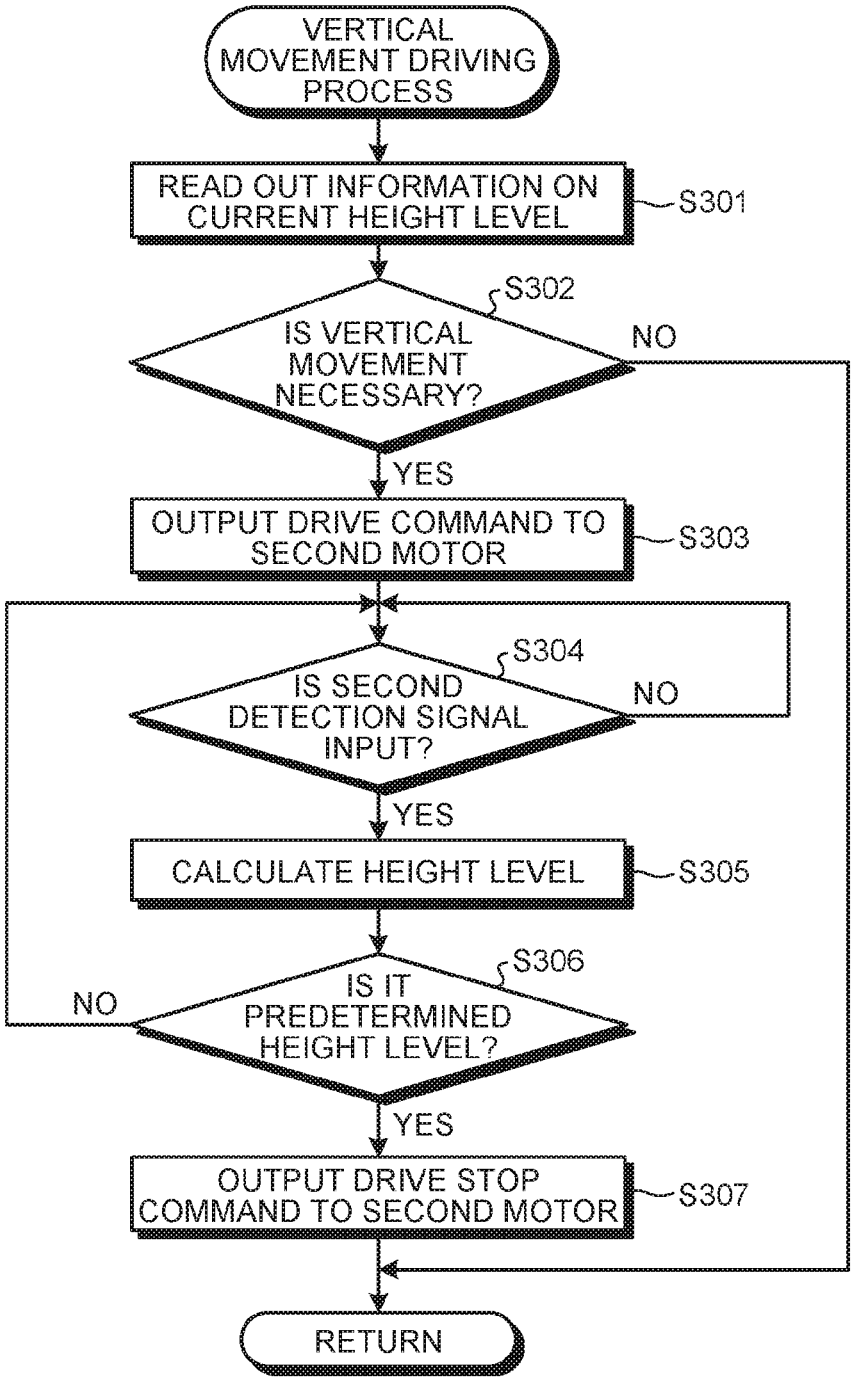
FIG. 13 is a flowchart illustrating processing content of a vertical movement driving process in the dispensing control process illustrated in FIG. 12.

FIG. 13 is a flowchart illustrating processing content of the vertical movement driving process in the dispensing control process illustrated in FIG. 12.

In the vertical movement driving process, the control unit 80 reads out the information on a current height level of the rotating plate 42 from the memory 80*a* (step S301). Here, the information on the current height level of the rotating plate 42 is set to a height level corresponding to the link member 50 that has served as a target of the previous dispensing control process, and accordingly, the information that the rotating plate 42 is present at the low-level position is read out herein.

The control unit 80, which has read out the information on the current height level of the rotating plate 42, determines whether the vertical movement is necessary as compared to the height level of the target link member 50 (step S302). Here, when it is determined that the vertical movement is not necessary (step S302: No), the control unit 80 causes the procedure to be returned without performing a process to be described later, and ends the vertical movement driving process of this time.

On the other hand, when the current height level of the rotating plate 42 is the low level, and it is determined that the vertical movement is necessary to allow the target link member 50 to be at the middle level (step S302: Yes), the control unit 80 outputs a drive command to the second motor 45*a* (step S303). To be specific, the control unit 80 outputs a forward rotational drive command to the second motor 45*a*. Accordingly, the second motor 45*a* is driven to rotate forward, and accordingly, the second transmission gear 45*d* rotates in the clockwise direction when seen from above. As a result, the first transmission member 461 rotates in the clockwise direction when seen from above, the transmission protrusion portion 48*c* of the second transmission member 462 relatively moves from the first planar portion 47*a* to the second planar portion 47*b*, and the second transmission member 462 moves upward to be spaced apart from the first transmission member 461 in the vertical movement transmission mechanism 46. Accordingly, the rotating plate 42 moves upward against the biasing force of the pressing spring 42*c*.

The control unit 80, which has output the forward rotational drive command to the second motor 45*a*, waits for input of the second detection signal from the second detection switch 72 (step S304). Further, when the second detection signal is input (step S304: Yes), the control unit 80 calculates the height level (step S305), and determines whether the rotating plate 42 is at a predetermined height level, that is, at a certain middle level of the target link member 50 (step S306).

When the rotating plate 42 is at the predetermined height level (middle level) (step S306: Yes), the control unit 80 outputs a drive stop command to the second motor 45*a* to stop the drive of the second motor 45*a* (step S307), and thereafter, the procedure is returned to end the vertical movement driving process of this time.

The control unit 80 that has ended the vertical movement driving process in this manner performs a rotation driving process (step S400).

Figure 14:
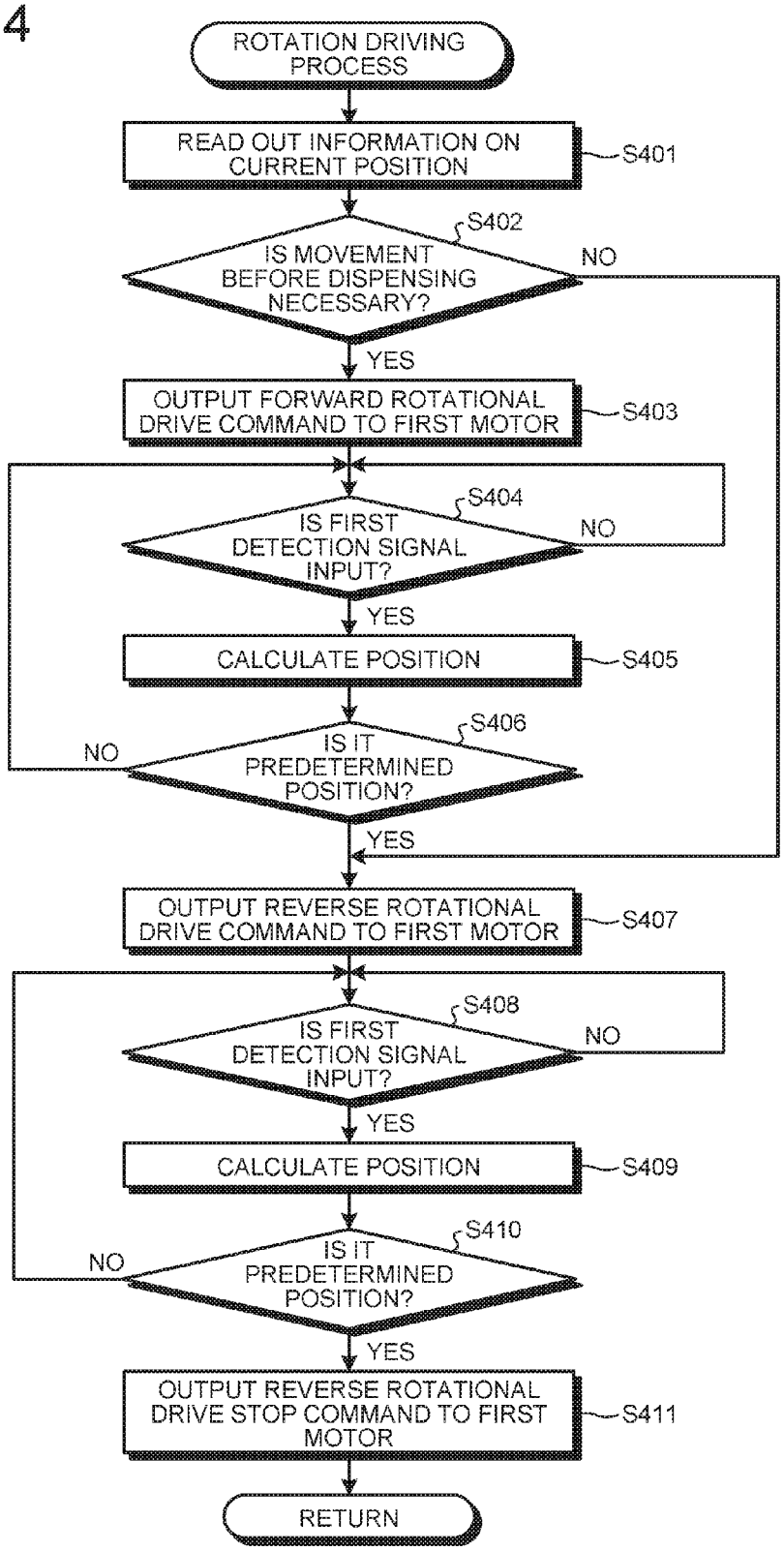
FIG. 14 is a flowchart illustrating processing content of a rotation driving process in the dispensing control process illustrated in FIG. 12.

FIG. 14 is a flowchart illustrating processing content of the rotation driving process in the dispensing control process illustrated in FIG. 12.

In the rotation driving process, the control unit 80 reads out the current position information from the memory 80*a* (step S401). Here, the current position information is information which relates to that a middle position between any of the link members 50 and any of the link members 50 at which the hook distal end 62 of the hook member 60 is positioned.

The control unit 80, which has read out the current position information, determines whether movement before dispensing is necessary based on a relation with the position information of the target link member 50 (step S402). This movement before dispensing causes the hook distal end 62 of the hook member 60 to move to a middle position (position before dispensing) between the target link member 50 and the other link member 50 neighboring on the target link member 50 in the counter-clockwise direction when seen from above.

Accordingly, when the hook distal end 62 of the hook member 60 is positioned at the position before dispensing based on the current position information, it is determined that the movement before dispensing is not necessary (step S402: No), and the control unit 80 transitions to a process of step S407 to be described later.

Figure 15:
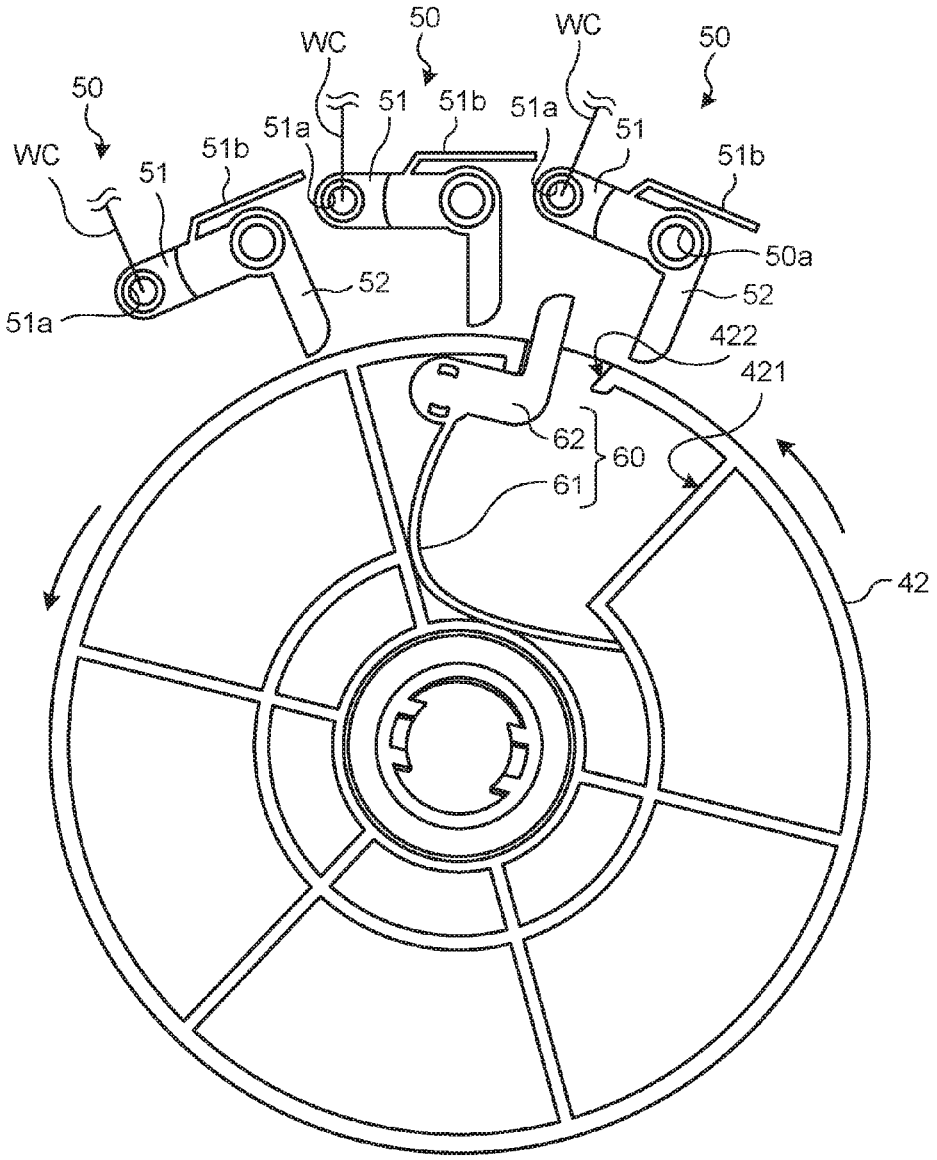
FIG. 15 is a schematic view schematically illustrating an operation of a hook member in the rotation driving process illustrated in FIG. 14.

On the other hand, when the link member 50 at the center among the three link members 50 is the target link member 50, and the hook distal end 62 is not positioned at the position before dispensing based on the current position information as in a case in which the hook distal end 62 is positioned at a middle position between the target link member 50 and the other link member 50 neighboring on the target link member 50 in the clockwise direction when seen from above as illustrated in FIG. 15, it is determined that the movement before dispensing is necessary (step S402: Yes), and the control unit 80 performs the following process.

Figure 16:
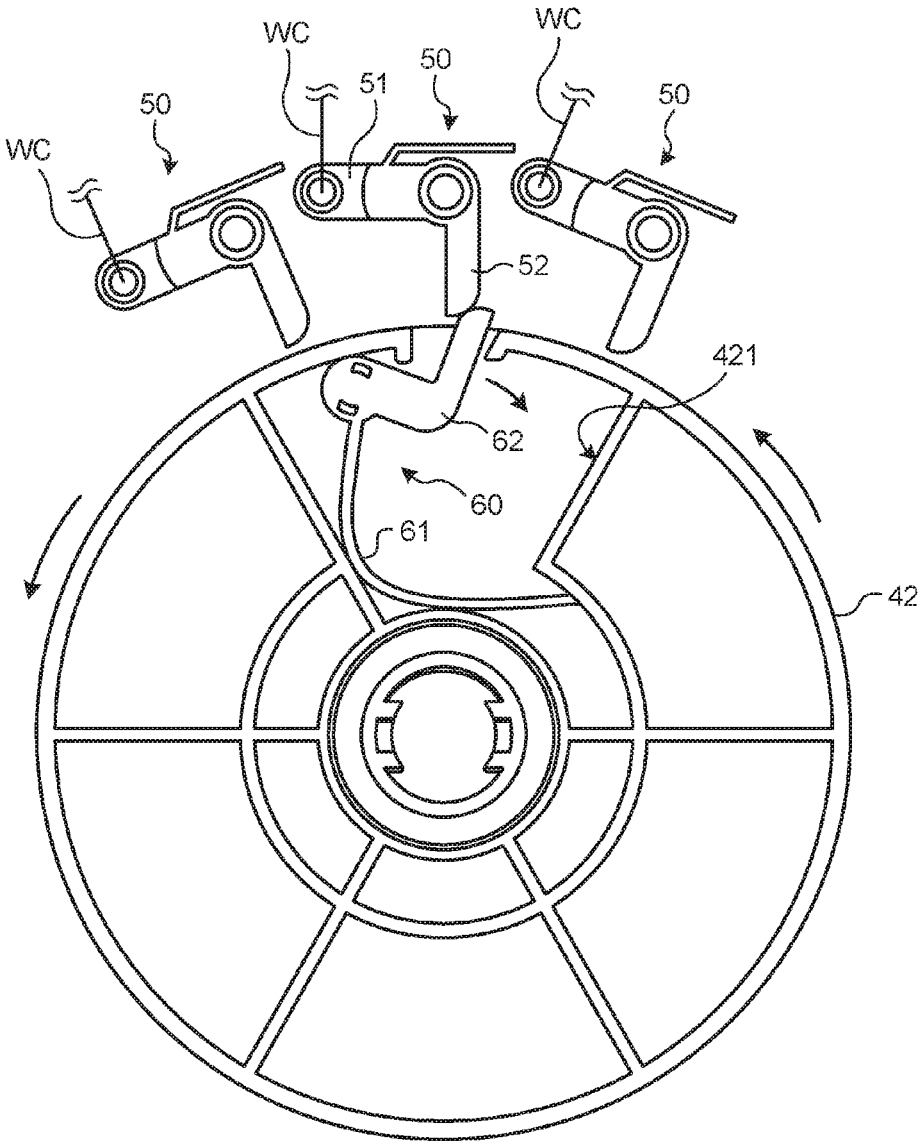
FIG. 16 is a schematic view schematically illustrating the operation of the hook member in the rotation driving process illustrated in FIG. 14.

The control unit 80 outputs the forward rotational drive command to the first motor 44*a* (step S403). Accordingly, the first motor 44*a* is driven to rotate forward, and the drive shaft 43 rotates in a counter-clockwise direction when seen from above, and accordingly, the rotating plate 42 rotates in a counter-clockwise direction. When the rotating plate 42 rotates in a counter-clockwise direction in this manner, the hook distal end 62 of the hook member 60 abuts against the link abutment portion 52 of the target link member 50 having the standby attitude. In this case, since the portion of the hook distal end 62 which faces the curved surface of the link member 50 (the link abutment portion 52) forms the curved shape, the hook distal end 62 is elastically deformed to rotate while being in sliding contact with the link abutment portion 52 as illustrated in FIG. 16. Further, the hook distal end 62 rotates by the elastic restoring force of the hook base portion 61 when the sliding contact with the link abutment portion 52 is canceled due to the rotation of the rotating plate 42, and has an attitude of abutting again against one edge portion of the open portion 422.

The control unit 80, which causes the first motor 44*a* to be driven to rotate forward in this manner, waits for input of the first detection signal from the first detection switch 71 (step S404). Further, when the first detection signal is input (step S404: Yes), the control unit 80 calculates a position (step S405), and determines whether the hook distal end 62 is at the predetermined position (the position before dispensing) (step S406).

Figure 17:
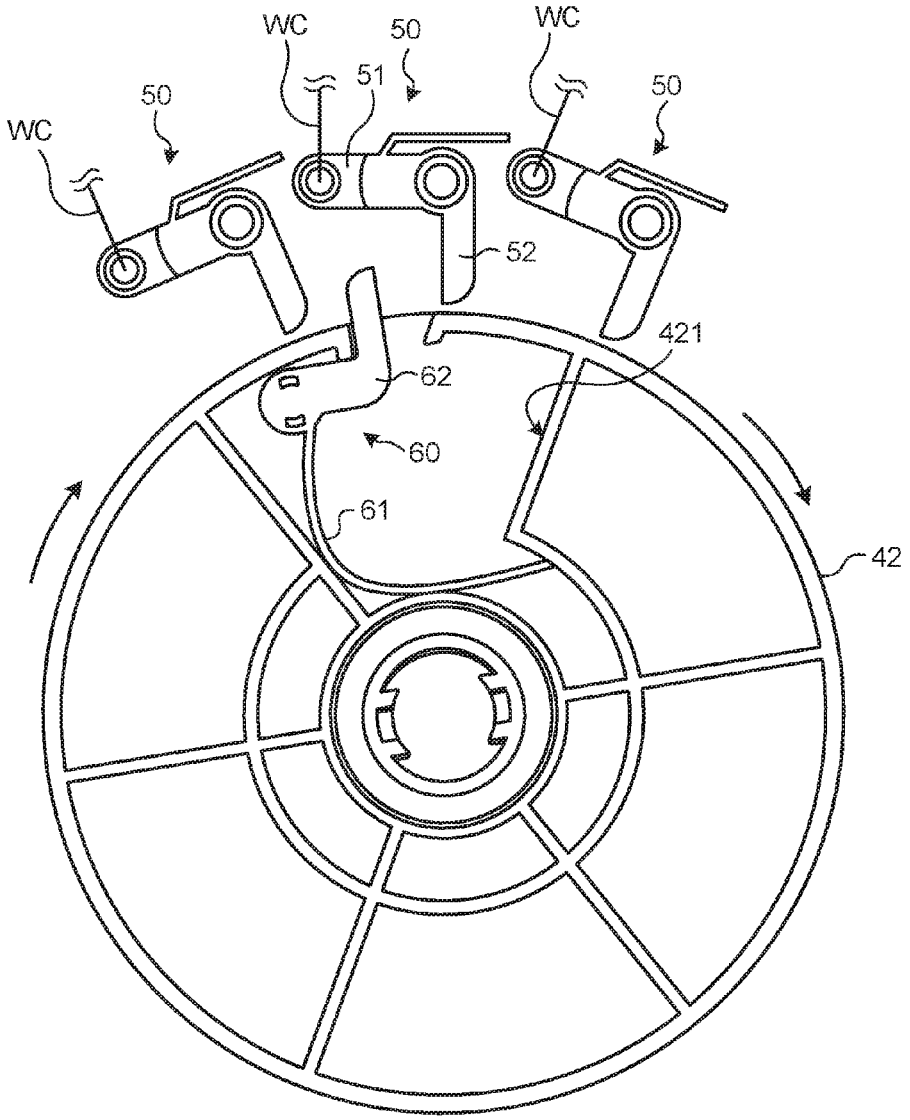
FIG. 17 is a schematic view schematically illustrating the operation of the hook member in the rotation driving process illustrated in FIG. 14.
Figure 18:
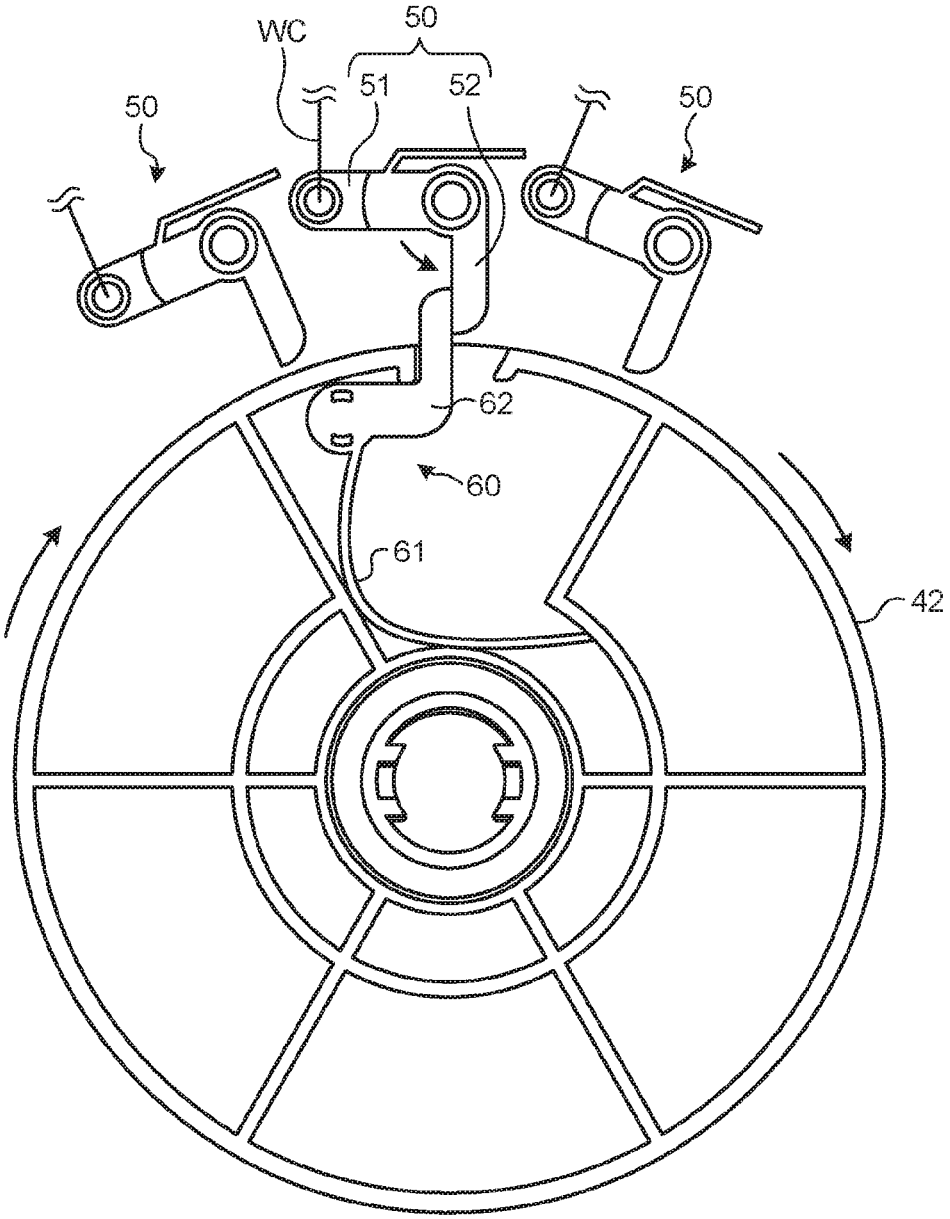
FIG. 18 is a schematic view schematically illustrating the operation of the hook member in the rotation driving process illustrated in FIG. 14.
Figure 19:
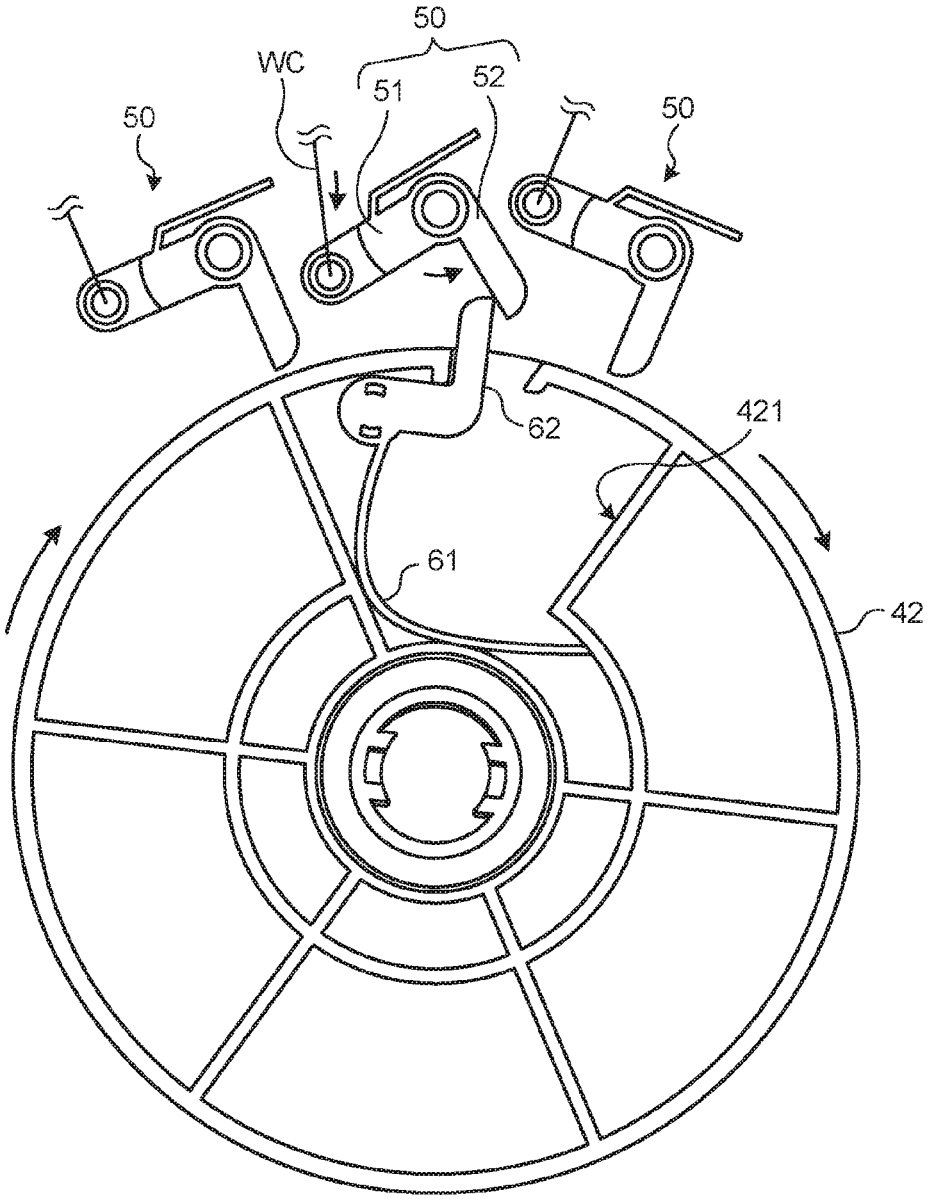
FIG. 19 is a schematic view schematically illustrating the operation of the hook member in the rotation driving process illustrated in FIG. 14.

As illustrated in FIG. 17, when the hook distal end 62 is at the predetermined position (the position before dispensing) (step S406: Yes), the control unit 80 outputs a reverse rotational drive command to the first motor 44*a* (step S407). Accordingly, the first motor 44*a* is driven to rotate reversely, and the drive shaft 43 rotates in the clockwise direction when seen from above, and accordingly, the rotating plate 42 rotates in the clockwise direction. When the rotating plate 42 rotates in the clockwise direction in this manner, the hook distal end 62 of the hook member 60 is adjacent to the target link member 50 having the standby attitude. Thereafter, when the hook distal end 62 abuts against the link abutment portion 52 of the target link member 50 as illustrated in FIG. 18, the target link member 50 rotates in the counter-clockwise direction about the shaft center of the insertion shaft 40*c*, and has a dispensing attitude as illustrated in FIG. 19.

When the target link member 50 rotates to have the dispensing attitude from the standby attitude in this manner, the wire cable WC attached to the link action portion 51 is pulled upward. When the wire cable WC is pulled upward, the link shaft 27*a* to which the other end of the wire cable WC is attached moves upward, and accordingly, the pedal link 27 starts to move upward against the biasing force of the link spring 30.

The stopper pin 28*a* moves upward from the lower end of the stopper pin insertion hole 263 along with the upward movement of the pedal link 27, and the pedal stopper pin 28*b* moves upward from the lower end of the pedal stopper pin support groove 264.

At this time, the stopper pin 28*a* moves upward while abutting against the stopper abutment portion 253 of the upper pedal 25, the upper pedal 25 moves forward from the initial position against the biasing force of the upper pedal spring as illustrated in FIG. 3. The forward movement of the upper pedal 25 is performed by the upward movement of the stopper pin 28*a*.

Further, the forward-moving upper pedal 25 abuts against the second product (hereinafter, referred to also as a next product) from the lowermost side as illustrated in FIG. 4, and regulates the next product from moving in the downward direction.

Meanwhile, the load of the product abutting against the lower pedal 24 maintained at the advancing position is applied to the rotation stopper 29, and thus, the rotation stopper 29 starts to move backward as the regulation on the backward movement is canceled by the upward movement of the pedal stopper pin 28*b*.

When the rotation stopper 29 starts to move backward in this manner, the pedal operating shaft 29*a* is detached from the fitting portion 243*a*, and the lower pedal 24 starts to move backward against the biasing force of the lower pedal spring by the own weight of the product. The pedal operating shaft 29*a* of the rotation stopper 29, which has been detached from the fitting portion 243*a*, moves along the first guide portion 243*b* toward a position at which the first guide portion 243*b* and the second guide portion 243*c* intersect each other.

Thereafter, the lower pedal 24 moves backward by the own weight of the lowermost product, and the downward movement of the lowermost product is allowed as illustrated in FIG. 4, and the lowermost product is dispensed downward. The dispensed product is guided into the product unloading port 3*a* through the product shooter 5, and further, is in the state of being capable of being taken out via the product removal port 2*a*.

Here, when the lowermost product slips through the lower pedal 24, the lower pedal 24 moves toward the advancing position by the elastic biasing force of the lower pedal spring, and the rotation stopper 29 also moves toward the advancing position by the elastic biasing force of the pedal operation member spring. When the lower pedal 24 and the rotation stopper 29 move toward the advancing position, the pedal operating shaft 29*a*, held at a position at which the first guide portion 243*b* and the second guide portion 243*c* intersect each other, moves toward the fitting portion 243*a* along the second guide portion 243*c*, and the lower pedal 24 and the rotation stopper 29 return to the advancing position.

During the above-described process, the pedal link 27 moves upward, the stopper pin 28*a* is positioned at the upper end of the stopper pin insertion hole 263, and the pedal stopper pin 28*b* is positioned at the upper end of the pedal stopper pin support groove 264.

Thereafter, when abutment between the hook distal end 62 and the target link member 50 is canceled, the pedal link 27 is biased by the link spring 30 and moves downward.

When the wire cable WC is pulled downward via the link shaft 27*a* due to the downward movement of the pedal link 27, the target link member 50 returns to the standby attitude from the dispensing attitude.

In addition, the stopper pin 28*a* moves downward from the upper end of the stopper pin insertion hole 263 along with the downward movement of the pedal link 27, and the pedal stopper pin 28*b* moves downward from the upper end of the pedal stopper pin support groove 264.

When the pedal stopper pin 28*b* moves downward, the pedal stopper pin 28*b* abuts against a predetermined portion on the back surface side of the rotation stopper 29 which has returned to the advancing position. Accordingly, the movement in the direction of moving backward is regulated, and the lower pedal 24 has the initial position which is set to the position of being moved forward with respect to the product accommodating passage 13.

Meanwhile, the upper pedal 25 is biased by the upper pedal spring and moves backward along with the downward movement of the stopper pin 28*a*. Accordingly, the downward movement of the next product is allowed, and thereafter, the next product abuts against the lower pedal 24, which has moved forward, is regulated from moving downward, and returns to the standby state.

The control unit 80, which has driven to reversely rotate the first motor 44*a* in this manner, waits for input of the first detection signal from the first detection switch 71 (step S408). Further, when the first detection signal is input (step S408: Yes), the control unit 80 calculates a position (step S409), and determines whether the hook distal end 62 is at a predetermined position (step S410). Incidentally, the predetermined position herein is a middle position (position after dispensing) between the target link member 50 and the link member 50 neighboring on the target link member 50 in the clockwise direction when seen from above.

When the hook distal end 62 is at the predetermined position (position after dispensing) (step S410: Yes), the control unit 80 outputs a reverse rotational drive stop command to the first motor 44*a* to stop the drive of the first motor 44*a* (step S411), and thereafter, the procedure is returned to end the rotation driving process of this time.

The control unit 80, which has ended the rotation driving process in this manner, outputs a fact that the dispensing operation is completed to the vending machine control unit 100 (step S500), and thereafter, the procedure is returned to end the dispensing control process of this time. Incidentally, the control unit 80 makes the information relating to the height level of the rotating plate 42 in the dispensing control process of this time, and the position information of the hook distal end 62 stored in the memory 80*a* if necessary.

According to the product dispensing device 10 that has been described above, the dispensing driving unit 10*b*, which includes the rotating plate 42, the link member 50, the hook member 60, and the like, is disposed in the upper region of the product accommodating rack 10*a*, and thus, the dispensing driving unit 10*b* is arranged at a position which is farthest away from the lowermost product, which is under the most severe temperature environment, inside the product storage box 4, and eventually, it is possible to suppress generation of trouble.

According to the product dispensing device 10, the common driving source (the first motor 44*a* and the second motor 45*a*) is disposed in the upper region of the product storage box 4, and thus, it is unnecessary to provide a wiring such as harness around the dispensing mechanism 20. Thus, there is no risk that air blowing generated by the blower fan 6*c* is hindered by the wiring provided around the dispensing mechanism 20, and accordingly, it is possible to make the air circulation in the product storage box 4 favorable, and to achieve improvement in cooling efficiency or heating efficiency.

According to the product dispensing device 10, the dispensing driving unit 10*b* is disposed in the upper region of the product storage box 4, and thus, it is possible to effectively use the upper region of the product accommodating rack 10*a* which is an empty space in the related art.

According to the product dispensing device 10, the plurality of dispensing mechanisms 20 are driven by the dispensing driving unit 10*b*, and thus, it is possible to reduce the number of parts including a driving source as compared to the related art in which each of the dispensing mechanisms 20 is required to have a driving source (AC solenoid), and accordingly, it is possible to achieve reduction in manufacturing cost.

According to the product dispensing device 10, each of the link members 50 is associated with the dispensing mechanism 20, and thus, it is possible to flexibly correspond to the number of the dispensing mechanisms 20, and the product dispensing device 10 can be easily applied to various types of vending machines, thereby improving the general versatility.

As above, the preferable embodiments of the present disclosure have been described, but the present disclosure is not limited thereto, and various modifications can be made.

Although the description has been given in the above-described embodiment regarding a case in which the product accommodating racks 10*a*, each of which has the two front and rear product accommodating passages 13, are arranged side by side in front and rear three columns, the number of the product accommodating racks 10*a* is not limited in the present disclosure, and further, the number of the product accommodating passages 13 provided in each of the product accommodating racks 10*a* is not limited, either.

According to the present disclosure, a disc-shaped member, which is disposed at a position spaced apart from a dispensing mechanism to be rotatable about a central axis thereof, rotates in one direction or another direction by a rotational driving force applied from the rotation driving source, link members, each of which is coupled with the associated dispensing mechanism via a coupling member and is swingably disposed in a radially outer region of the disc-shaped member, has a standby attitude in a normal state to cause the dispensing mechanism to be in a standby state, and causes the dispensing mechanism to be driven when swinging from the standby attitude to have a dispensing attitude, and a hook member, which is rotatably disposed in the disc-shaped member in a manner such that a distal end thereof moves forward and backward in the radially outer region of the disc-shaped member, causes the link member to swing to have the dispensing attitude when the disc-shaped member rotates in the one direction so that the distal end abuts against the link member, and retreats from the radially outer region when the disc-shaped member rotates in the other direction so that the distal end abuts against the link member, and thus, it is possible to cause a desired dispensing mechanism to be driven even when a common driving source is disposed at a position spaced apart from the dispensing mechanism. Further, the common driving source is disposed at a position spaced apart from the dispensing mechanism, and thus, is arranged at a position which is farthest away from a downstream side of the product accommodating passage, which is under the most severe temperature environment, and eventually, an effect that it is possible to suppress generation of trouble in the dispensing mechanism is obtained.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A product dispensing device comprising:

a plurality of product accommodating passages which accommodate an introduced product with a predetermined attitude;

a dispensing mechanism which is disposed on each downstream side of the product accommodating passages, regulates a product accommodated in the corresponding product accommodating passage from moving toward the downstream side in a standby state, and dispenses a product positioned at a most downstream side accommodated in the corresponding product accommodating passage when being driven;

a disc-shaped member which is disposed at a position spaced apart from the dispensing mechanism rotatably about a central axis thereof, and rotates in one direction or another direction by a rotational driving force applied from a rotation driving source;

a plurality of link members each of which is coupled with the corresponding dispensing mechanism via a coupling member and swingably disposed in a radially outer region of the disc-shaped member, and has a standby attitude in a normal state to cause the dispensing mechanism to be in the standby state, and causes the dispensing mechanism to be driven when swinging from the standby attitude to have a dispensing attitude; and a hook member which is rotatably disposed in the disc-shaped member in a manner such that a distal end thereof moves forward and backward in the radially outer region of the disc-shaped member, has an attitude in which the distal end enters the radially outer region in a normal state, causes the link member to swing to have the dispensing attitude when the disc-shaped member rotates in the one direction so that the distal end abuts against the link member, and retreats from the radially outer region when the disc-shaped member rotates in the other direction so that the distal end abuts against the link member.

2. The product dispensing device according to claim 1, further comprising a movement driving source which applies a driving force to the disc-shaped member to cause the disc-shaped member to move along an axial direction of the central axis, wherein the link member is disposed along the axial direction of the central axis of the disc-shaped member in the radially outer region of the disc-shaped member, and the disc-shaped member is capable of moving along the axial direction of the central axis.

3. The product dispensing device according to claim 2, wherein the rotation driving source and the movement driving source are direct current motors.

* * * * *